US005992712A

United States Patent [19]

Nishikawa et al.

[11] Patent Number: 5,992,712

[45] Date of Patent: Nov. 30, 1999

[54] METHOD AND APPARATUS FOR PROCESSING HOSE MATERIAL

[75] Inventors: Etsuo Nishikawa; Shinji Kimura, both of Gose; Koichi Morioka, Kashihara, all of Japan

[73] Assignee: Takatori Corporation, Nara-ken, Japan

[21] Appl. No.: 09/085,415

[22] Filed: May 27, 1998

[30] Foreign Application Priority Data

Jul. 10, 1997 [JP] Japan ..... 9-202297

[51] Int. Cl.[6] ..... D06C 5/00

[52] U.S. Cl. ..... 223/1; 223/39; 223/112

[58] Field of Search ..... 223/1, 112, 42, 223/43, 39

[56] References Cited

U.S. PATENT DOCUMENTS 4,566,615 1/1986 Nakahira ..... 223/43
5,040,475 8/1991 Fournier et al. .
5,165,355 11/1992 Fournier et al. .
5,456,392 10/1995 Majors ..... 223/112
5,651,483 7/1997 Bell et al. .
5,769,286 6/1998 Conti ..... 223/75
5,844,822 3/1999 Migliorini ..... 223/1

*Primary Examiner*—Bibhu Mohanty
*Attorney, Agent, or Firm*—Alston & Bird LLP

[57] ABSTRACT

Panty hose sewing processes can be fully automatized (allowing unattended operation) by providing a processing apparatus which is enabled to perform working steps from the pickup of hose material to the opening of the welt portion by using suction air flow synchronously and iteratively under phase differences in working position for the respective working steps, and which allows one piece of hose material to be taken out at a time with reliability, and yet which fully opens the welt portion onto the slide pipe in an unfolding manner and delivers the welt portion to a fitting arm with reliability.

24 Claims, 33 Drawing Sheets

METHOD AND APPARATUS FOR PROCESSING HOSE MATERIAL

BACKGROUND OF THE INVENTION

The present invention relates to method and apparatus for processing hose material in which hose material is delivered to a fitting arm which automatically fits the hose material to a bite member in a crotch sewing machine for panty hose in a state that the welt portion of the hose material is opened.

In manufacturing panty hose, two cylindrical pieces of hose material are set with their welt portions aligned right and left, in which state their thigh portions which form the panty part are sewn by a crotch sewing machine, and then the tip portions of this hose material pieces are sewn by a toe sewing machine. Thus, a pair of panty hose can be obtained.

The piece of panty hose finished with the sewing work is further subjected to various working processes such as dyeing, set finishing and packaging, thus being formed into a product.

As described above, the panty hose has been produced through the two processes of crotch sewing and toe sewing. As sewing machines for performing both processes, the automatic crotch sewing machine (U.S. Pat. No. 3,777,681) and the automatic toe sewing machine (U.S. Pat. No. 4,133,280) that the present inventor previously developed have been widely used.

Also, for the production of panty hose using these two sewing machines, there have been proposed, by U.S. Pat. No. 5,040,475 and U.S. Pat. No. 5,165,355, a processing apparatus which can feed suction-conveyed hose material for the welt-portion opening mechanism which makes the welt portion of the hose material opened by suction air flow in a fixed position, and which allows the panty hose sewing process to be completely automatized by connecting the welt-portion opening mechanism to the fitting arm of the crotch sewing machine.

In these processing apparatuses, pickup means for lifting the hose material to just above a storage container that randomly stores the hose material therein, and the lifted hose material is transported by transport pipe with air turbulence. During this transport, it is detected by sensor means whether the front end portion of the hose material is a welt portion or a toe, depending on a quantitative difference between welt portion and toe. After this, the hose material is posture-controlled and delivered to the welt-portion opening mechanism.

In this connection, the pickup means in the conventional processing apparatus as described above would be such that, in picking up the hose material, two pickup means are used and operated to go up and down in two stages, where the hose material is picked up from the storage container at the first stage, and re-picked up at the free end portion of the picked-up material at the second stage, so that the picked-up material is shaken off into one material piece so as not to pick up any plurality of material. At the second stage, a free end of this picked-up material is re-picked up and shaken off into open piece. However, this would result in much time consumption for the pickup work of the hose material so that the whole apparatus could not be operated efficiently. Moreover, this would result in a deterioration of the crotch sewing machine or toe sewing machine.

Also, the hose material picked up at the first stage is not always picked up under the same conditions so that they are picked up in an unstable state such as a folded-in-two state or materials entangled state. Therefore, at the second-stage re-picking state, the material is not necessarily shaken off into open piece, which causes a problem of deficient reliability.

Further, the conventional welt-portion opening mechanism as described above is not to completely unfold the welt portion at the opening end of the pipe but only to open it into, for example, a bugle shape, thus resulting in an unstable opening stat. As a result, the opening portion, even if opened, may shrink when the fitting arm is inserted into the opening portion, so that the delivery to the fitting arm cannot be performed smoothly, which would make an obstacle to the delivery work. In particular because this delivery work is the final process of the processing apparatus, it may be a critical defect to the processing apparatus.

SUMMARY OF THE INVENTION

Therefore, an object of the present invention is to provide method and apparatus for processing hose material which allow the steps from the pickup process of hose material to the delivery step of the opened welt portion to the fitting arm to be achieved promptly and efficiently under the phase difference between the individual working positions and moreover allow one hose material to be reliably taken out, and yet which allows the welt portion to be accurately and reliably delivered onto the fitting arm by opening the welt portion in such a manner as to unfold it on the pipe.

In order to solve the above object, according to a first aspect of the present invention, there is provided a method for processing hose material including steps of taking out one piece of hose material stored randomly in a storage container, conveying the hose material within a transport pipe by a suction air flow, controlling posture of the hose material so that a welt portion of the hose material is headed on the way of the conveyance, and feeding the hose material to a welt-portion opening mechanism, opening the welt portion by action of the suction air flow within a pipe of the opening mechanism, and delivering the opening portion onto a fitting arm, the method comprising: using pickup means which ascends and descends above the storage container to suck up and hold the hose material placed within the storage container, detecting whether a free end of the hose material is a welt portion or a toe portion, depending on thickness of the material during the process that the pickup means lifts the material, wherein depending on the detection, the hose material can be posture-controlled in the transport pipe.

According to a second aspect of the present invention, there is provided a method for processing hose material as defined in the first aspect, further comprising: providing stock means for hose material halfway on the transport pipe, and temporarily stocking the hose material fed toward the welt-portion opening mechanism after the posture-control.

According to a third aspect of the present invention, there is provided an apparatus for processing hose material for performing steps of taking out one piece of hose material stored randomly in a storage container, conveying the hose material within a transport pipe by a suction air flow, controlling posture of the hose material so that a welt portion of the hose material is headed on the way of the conveyance, and feeding the hose material to a welt-portion opening mechanism, opening the welt portion by action of the suction air flow within a pipe of the opening mechanism, and delivering the opening portion onto a fitting arm, the apparatus comprising: pickup means, placed just above the storage container, in which a nozzle member for use of suckup of the hose material ascends and descends within a vertical guide pipe; and detection means, provided under the guide pipe of the pickup means, for detecting whether a free end of the hose material lifted by the nozzle member is a welt portion or a toe portion, depending on its thickness, wherein the transport pipe is branched and connected to the guide pipe at a position upper than the detection means.

According to a fourth aspect of the present invention, there is provided an apparatus for processing hose material as defined in the third aspect, wherein the pickup means has suction holes for suction of the hose material formed in a side face of the nozzle member which ascends and descends within the guide pipe.

According to a fifth aspect of the present invention, there is provided an apparatus for processing hose material as defined in the fourth aspect, further comprising stock means for temporarily stocking the hose material which comprises a shutter for intercepting and opening the guide pipe, and an outer cylinder for covering exterior of the guide pipe on upstream side of the shutter, and which temporarily stocks the hose material fed toward the welt-portion opening mechanism after the posture-control.

According to a sixth aspect of the present invention, there is provided an apparatus for processing hose material as defined in any one of the third to fifth aspects, further comprising: a material stretching pipe provided at a place where the guide pipe reaches the welt-portion opening mechanism; a pair of material rollers which allow the material to be pinched and opened, and which allow the material to be changed in speed are incorporated in a closed box provided halfway on the material stretching pipe; two holed shutters openably and closably provided between the closed box and the welt-portion opening mechanism; and a discharge pipe, for discharge of the hose material, connected between the closed box and the holed shutters.

According to a seventh aspect of the present invention, there is provided a method for continuously processing hose material, the method comprising: a step for picking up the hose material randomly stored in a storage container and conveying from a lowermost end portion of the storage container to within a flat-lay passage by a suction air flow; a step for, within the flat-lay passage, holding one end of the conveyed hose material that has first reached thereto and stretching the other end of the hose material and laying it flat along the longitudinal direction of the flat-lay passage, and lifting the flat-laid hose material from the flat-lay passage by holding the hose material at a specified portion thereof; a step for detecting whether the lowermost end of the lifted hose material is a toe portion or a welt portion during the lifting process of the hose material and, depending on the detection, posture controlling the hose material so that the welt portion of the hose material is headed on a way of suction conveyance within the transport pipe; and a step for feeding the posture-controlled hose material to the welt-portion opening mechanism and making the welt portion opened by action of the suction air flow within the pipe of the opening mechanism, and delivering the opening to the fitting arm, wherein these steps are performed synchronously and iteratively.

According to an eighth aspect of the present invention, there is provided a method for processing hose material as defined in the seventh aspect, wherein in the step of laying the hose material flat along the longitudinal direction of the flat-lay passage, when two or more pieces of hose material are conveyed into the flat-lay passage, one piece of hose material is left and the other hose material is returned into the storage container through the discharge pipe.

According to a ninth aspect of the present invention, there is provided a method for processing hose material as defined in the seventh aspect, further comprising, in the step of opening the welt portion of the hose material, moving the welt portion of the hose material toward a pipe opening end while pinching a leg portion of the hose material with a pair of rollers within the pipe in which a suction air flow acts, and fully unfolding the welt portion onto an outer periphery of the pipe opening end by the movement of the welt portion and the action of the suction air flow.

According to a tenth aspect of the present invention, there is provided a method for processing hose material as defined in the ninth aspect, further comprising a step of detecting the welt portion unfolded onto the outer periphery of the pipe opening end with a plurality of sensors, and temporarily pinching the unfolded welt portion at a plurality of places of the welt portion.

According to an eleventh aspect of the present invention, there is provided an apparatus for continuously processing hose material having a toe portion at one end and a welt portion at the other end and knit into a cylindrical shape, the apparatus comprising: a storage container for randomly storing a multiplicity of pieces of hose material; a first pickup mechanism ascendably/descendably supported above the storage container; means for sucking up and conveying the hose material picked up from the storage container by the first pickup mechanism; a longitudinal flat-lay passage for straightly stretching the conveyed hose material and laying it down flat, the flat-lay passage having a holding jig for temporarily holding one end of the hose material at one side of the flat-lay passage and a guide pipe vertically branched and connected to the flat-lay passage, where a second pickup mechanism for lifting the hose material laid down within the flat-lay passage at a specified portion of the hose material and lifting the hose material upward is ascendably/descendably supported to the guide pipe; detection means for detecting whether a lowermost end portion of the lifted hose material is a toe portion or a welt portion; means for posture-controlling the hose material so that its welt portion is headed, depending on a detection result by the detection means; and a welt-portion opening mechanism for opening the welt portion of the hose material.

According to a twelfth aspect of the present invention, there is provided an apparatus for processing hose material as defined in the eleventh aspect, wherein a discharge pipe for discharge of the hose material is connected to the flat-lay passage on its one side opposite to the side on which the holding jig is provided so that the discharge pipe communicates with the storage container.

According to a thirteenth aspect of the present invention, there is provided an apparatus for processing hose material as defined in the eleventh aspect, wherein a plurality of sensors for detecting the unfolded welt portion and a plurality of pinching jigs for temporarily pinching the hose material are arranged at a pipe opening end of the welt-portion opening mechanism so as to be spaced equidistantly on the pipe circumference.

In a first embodiment as will be described below, as to the hose material that has been picked up and lifted from the storage container by the pickup means, the detection means detects during the lifting process whether its lower end is a welt portion or a toe portion, depending on the thickness difference. After this detection, the hose material is sucked up to the transport pipe, where if the front end is a welt portion, the hose material is sent to the stock means as it is, and if the front end is a toe, the hose material is posture-controlled by the reversal means so as to be postured with the welt portion at the front end, and sent to the stock means. The hose material sent from the stock means to the material stretching pipe is held by the holed shutter, and then moved by being pinched by the up-and-down feed roller of the closed box, so that the stretched hose material is fed to the welt-portion opening mechanism, where it is opened.

Also, in a second embodiment as will be described below, the hose material picked up from the storage container by the first pickup mechanism is conveyed from the lowermost end portion into the flat-lay passage, and within the flat-lay passage, the conveyed hose material is held at its first-reaching one end portion, and the other portion is stretched so that the hose material is laid down along the longitudinal direction of the flat-lay passage. In this process, if two or more pieces of material are conveyed to within the flat-lay passage, one piece of material laid down flat is left as it is and the other is returned into the storage container through the discharge pipe.

The hose material laid down flat within the flat-lay passage is next lifted from the flat-lay passage by the second pickup mechanism. In this lifting process, the detection means detects whether its lower end is a toe portion or a welt portion, depending on the thickness difference. After this detection, the hose material is sucked up to the transport pipe, where if the front end is a toe portion, the hose material is sent to the welt-portion opening mechanism as it is, and if the front end is a toe portion, the hose material is posture-controlled by the reversal means so as to be postured with the welt portion at the front end, and sent to the welt-portion opening mechanism. After that, the hose material sent to the welt-portion opening mechanism is moved by being pinched by a pair of feed rollers, where the welt portion is opened by this movement and the action of suction stream.

DETAILED DESCRIPTION OF THE PREFERRED EMBODIMENTS

A first embodiment of the present invention is described below with reference to FIGS. 1 to 18.

Figure 1:
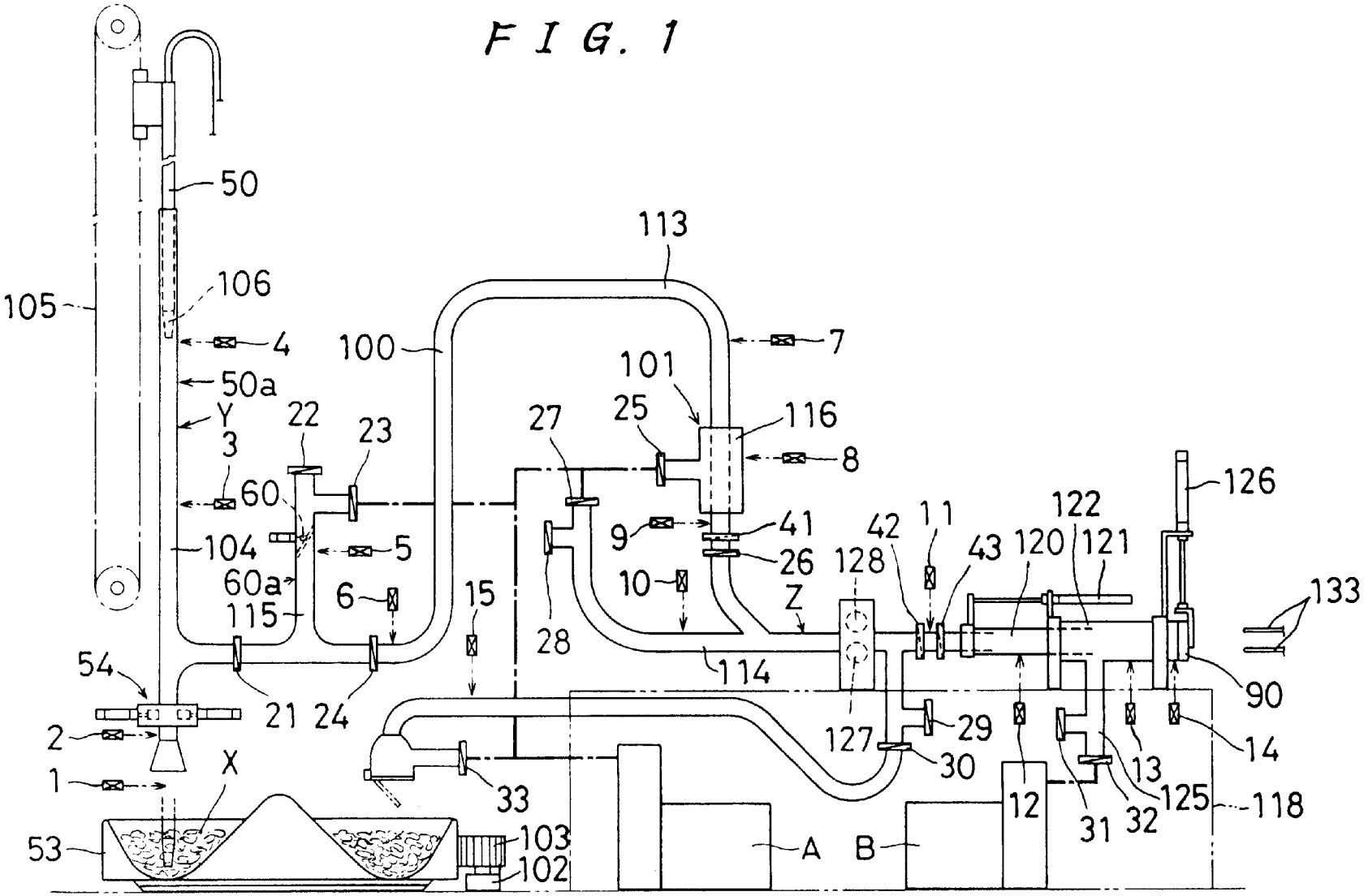
FIG. 1 is a side view showing the initial state of the whole processing apparatus according to a first embodiment of the present invention.
Figure 2:
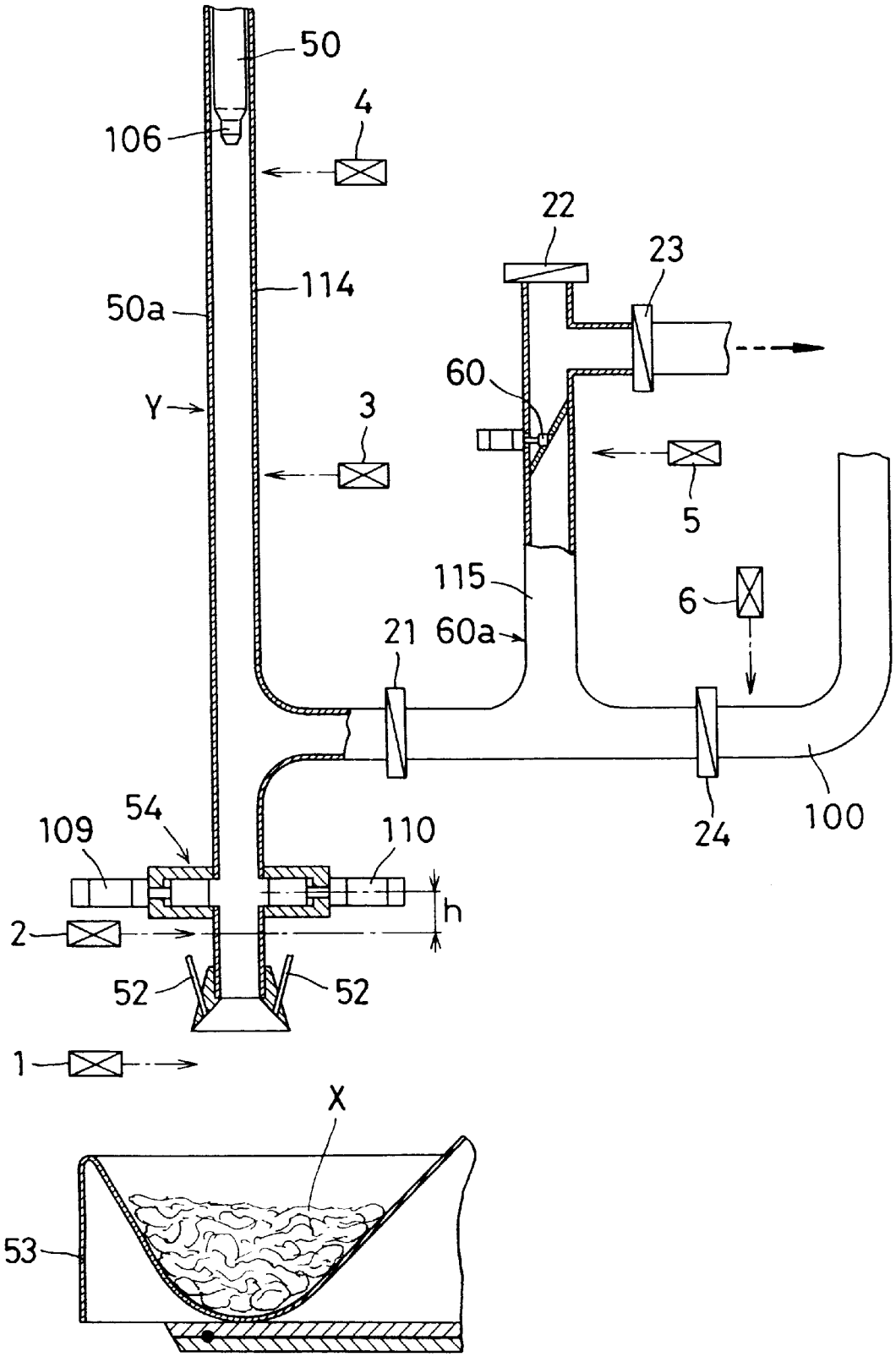
FIG. 2 is an enlarged partly cutout side view of the pickup means in the same embodiment.
Figure 3:
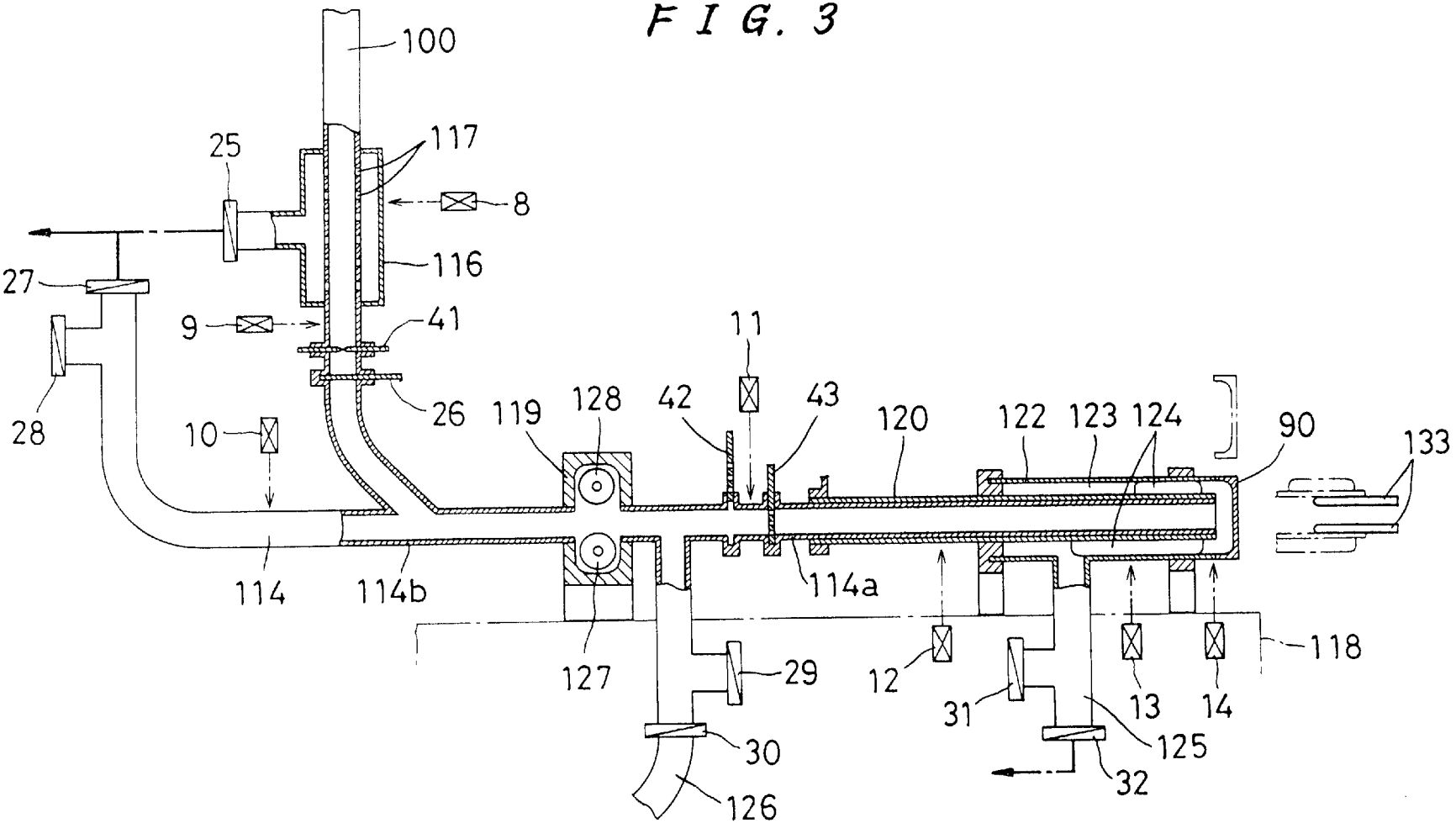
FIG. 3 is a partly cutout side view of the welt-portion opening mechanism in the same embodiment.

FIG. 1 shows the whole construction of a hose material processing apparatus. This processing apparatus comprises a feed-posture control mechanism Y for hose material X in a former-stage step, and a welt-portion opening mechanism Z in a latter-stage step. The feed-posture control mechanism Y comprises a storage container 53 for randomly storing the hose material X, pickup means 50*a* placed just above the storage container 53, a transport pipe 100 branched and connected to the pickup means 50*a*, reversal means 60*a* provided in proximity to the pickup means 50*a* on the way of the pipe 100, and stock means 101 provided on the downstream side of the transport pipe 100.

The storage container 53 is continuously rotated at low speed by a roller 103 of a motor 102 which makes sliding contact with an outer circumferential surface of the storage container 53. The pickup means 50*a* is so constructed that a guide pipe 104 elongated in the up-and-down direction with its lower end enlarged in diameter into a taper shape is vertically fixed just above the storage container 53, where a pickup bar 50 housed within the guide pipe 104 is coupled to an endless chain 105 and driven by a reversible servo motor so that the pickup bar 50 moves up and down so as to be position-controllable.

Figure 4:
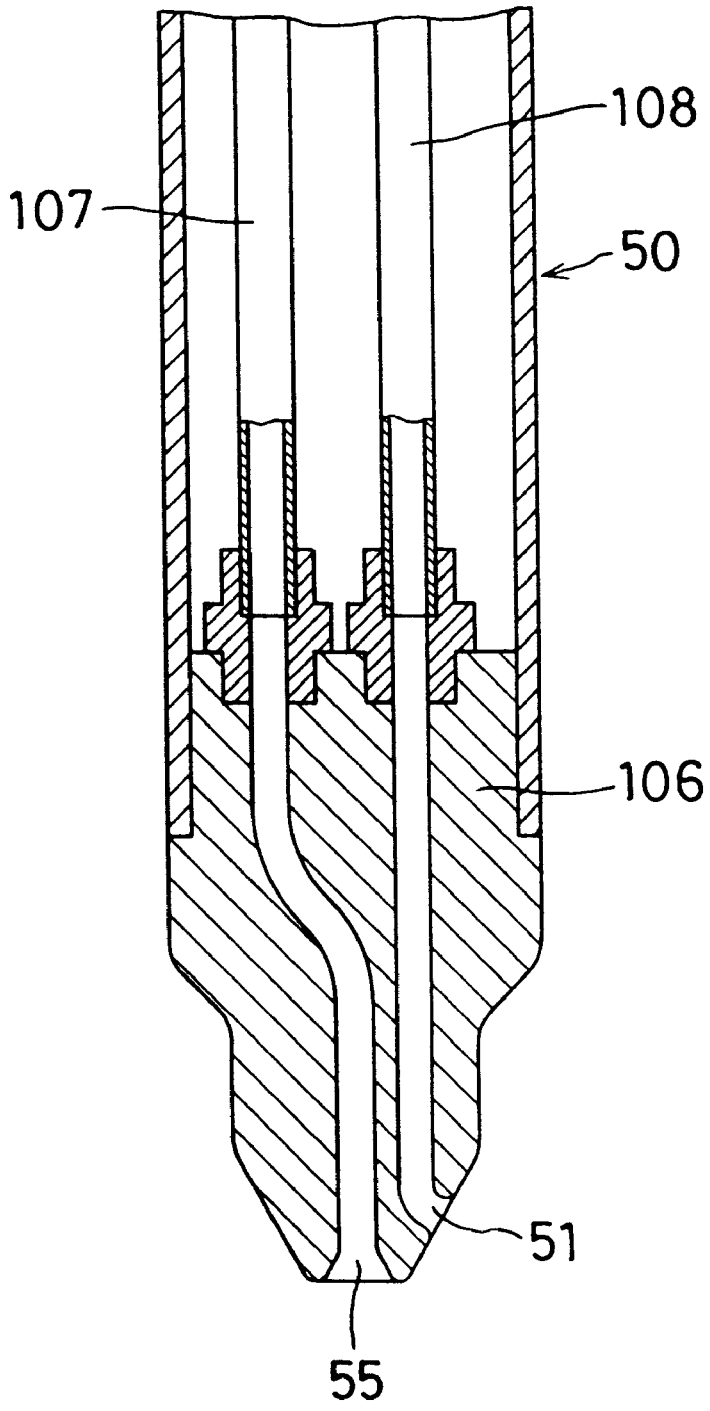
FIG. 4 is an enlarged sectional view showing the nozzle of the pickup means.

A lower end of the pickup bar 50 is formed into a truncated-conical nozzle 106 as shown in FIG. 4, and an air jet hole 55 provided opened at its lower end face is connected to a compressed air supply source via piping 107. Also, a suction hole 51 provided so as to be opened at a slanted front end side face of the nozzle 106 is connected to a vacuum pump via piping 108.

At a lower end of the guide pipe 104, is provided a detection means 54 for detecting whether the lower end of the hose material X sucked up and lifted by the nozzle 106 is a welt portion or a toe portion, depending on the thickness.

Figure 17:
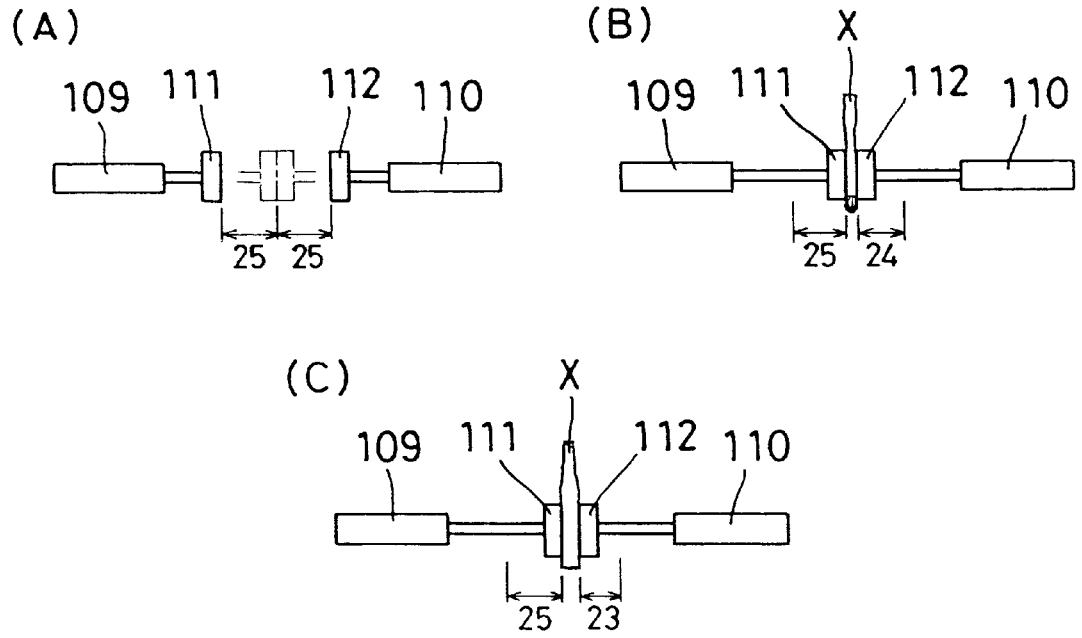
FIGS. 17 (A)–(C) are explanatory view showing a detecting operation of the detecting means.

This detection means 54 is so arranged, as shown in FIG. 17, that cylinders 109, 110 are placed so as to sandwich the center shaft of the guide pipe 104 therebetween and that pinching jigs 111, 112 are provided to piston rods of the cylinders 109, 110. While the travel stroke of one cylinder 109 is made constant, piston travel of the other cylinder 110 is measured by an encoder or magnet scale, by which the thickness difference of the welt portion or the toe portion is detected by pinching them with the two pinching jigs 111, 112.

For example, if the stroke of the two cylinders 109, 110 is 25 mm, it is preliminarily set (taught) that when one cylinder 109 is moved over the entire stroke while the other cylinder 110 is moved with a portion of the material thickness left, a resulting travel of 24 mm or more is determined as a toe portion of thin thickness as shown in FIG. 17 (B), and a resulting travel of not more than 24 mm is determined as a welt portion as shown in FIG. 17 (C).

Sensors 1, 2, 3, 4 for detecting the hose material X are placed at positions between the guide pipe 104 and the storage container 53, just under the detection means 54, and intermediate and upward of the guide pipe 104, respectively.

At a position in lower part of the guide pipe 104 and just above the detection means 54, the transport pipe 100 for sucking up and conveying the hose material X lifted into the guide pipe 104 by an ascent of the nozzle 106 is branched and connected to the guide pipe 104. On this transport pipe 100, the reversal means 60*a* is provided on the way of the transport pipe 100 and the stock means 101 is provided at a terminal end of a rising portion 113 of the transport pipe 100. The transport pipe 100 is then connected to a halfway point of a material stretching pipe 114 in the welt-portion opening mechanism Z. Referring to the reversal means 60*a*, a reversal pipe 115 is connected thereto at a position between opening/closing shutters 21, 24 provided on the way of the transport pipe 100, while opening/closing shutters 22, 23 are provided at an upper end and an upper side face of the reversal pipe 115, and further a material holding jig 60 is provided on the way of the transport pipe 100. Also, sensors 5, 6 for material detection are placed at places outside an intermediate portion of the reversal pipe 115 and slightly downstream of the shutter 24 of the transport pipe 100, respectively, and the reversal pipe 115 is connected to a suction source A via the shutter 23.

The stock means 101 has a both-side-openable holed shutter 41 and an opening/closing shutter 26 provided at terminal portions of the rising portion 113. An outer cylinder 116 is externally fitted to the upstream side of these, and a multiplicity of suction holes 117 are provided at a region covered with the outer cylinder 116 of the transport pipe 100, where the outer cylinder 116 is connected to the suction source A via an opening/closing shutter 25. Further, sensors 7, 8, 9 for detecting the hose material X are placed on the upstream and downstream sides of the outer cylinder 116 and outside the outer cylinder 116, respectively.

Referring to the welt-portion opening mechanism Z the material stretching pipe 114 installed horizontal on a rack 118 is divided into a front pipe 114*a* and a rear pipe 114*b* by a closed box 119 provided on the way of the material stretching pipe 114, where the transport pipe 100 is connected to a halfway point of the rear pipe 114*b*, a rear end of the rear pipe 114*b* is connected to the suction source A via a shutter 27 and the rear end side face of the rear pipe 114*b* can be communicated with and shut off from outside air via a shutter 28. A detection sensor 10 for hose material is placed outside the rear pipe 114*b*.

A slide pipe 120 is externally fitted to outside of the front pipe 114*a* so as to be movable axially. The slide pipe 120 is given back-and-forth movement by an air cylinder 121 so that the front end of the slide pipe 120 moves in a specified stroke forward from a retreat position where the end coincides with the front end of the front pipe 114*a*.

A large-diameter pipe 122 is provided by being externally fitted at a position outside the slide pipe 120 and closer to its front end and in such a fixed placement as to be coaxial with the front pipe 114*a*. A suction passage 123 with its rear end side closed is formed between the inner diameter of the large-diameter pipe 122 and the slide pipe 120, and a plurality of fins 124 with different lengths provided radially on the slide pipe 120 are provided radially on the front end side of the suction passage 123, so that the suction passage 123 is subdivided by these fins 124.

Halfway on the large-diameter pipe 122, a suction pipe 125 connected to a strong suction source (B) is connected so as to communicate with the suction passage 123, and the front end of this large-diameter pipe 122 is opened at the position of the front end of the front pipe 114*a*. This opening can be opened or closed by a lid 90 which is actuated by a cylinder 126.

Thus, by subdividing the suction passage 123 with a plurality of fins 124 different in length from one another, a suction air flow that acts on the passage 123 via the suction pipe 125 acts evenly on the interiors of the subdivisions of the suction passages 123 in the entire outer periphery of the slide pipe 120. As a result of this, the welt portion of the hose material X also expands in the same direction, i.e., outward as if it were a bud blooming of a flower, thus being sucked up while opened.

In addition, sensors 12, 13, 14 for material detection are placed outside the large-diameter pipe 122 and the slide pipe 120.

The suction pipe 125 is connected to the suction source B of exclusive use via a shutter 32 and can be switchably communicated with and shut off from outside air with a shutter 31.

Halfway of the front pipe 114*a*, holed shutters 42, 43 are provided between the closed box 119 and the slide pipe 120, and a sensor 11 of material detection is placed outside between the holed shutters 42, 43. A discharge pipe 126 is branched and connected to between the holed shutter 42 and the closed box 119, and shutters 29, 30 are provided at a halfway root-sided place and a side place of the pipe 126, respectively. An end portion of the pipe 126 is connected to the suction source A via a shutter 33, where a detection sensor 15 for detection of the hose material X is provided on the way of the pipe 126 closer to the end portion.

Within the closed box 119, a pair of upper-and-lower feed rollers 127, 128 using wear-resistant rubber material are provided.

Figure 18:
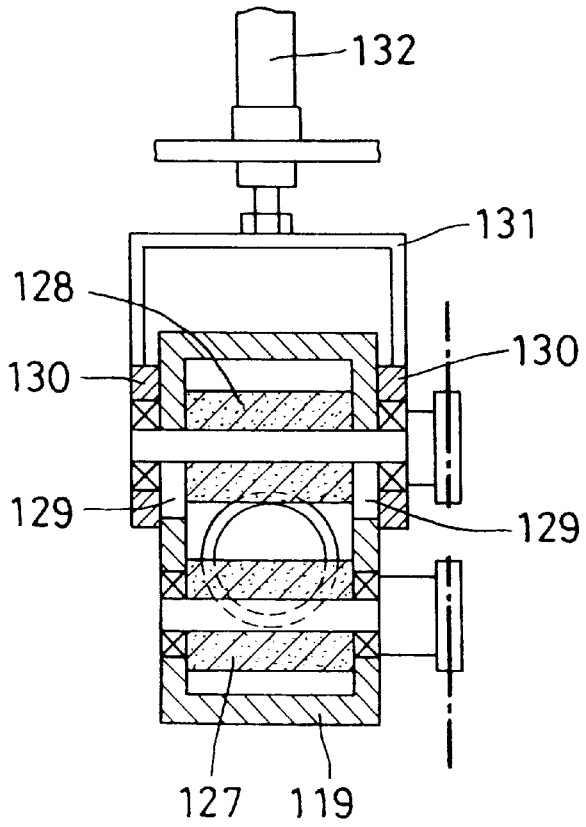
FIG. 18 is a longitudinal sectional view of the closed box.

As shown in FIG. 18, the lower feed roller 127 has its shaft supported by the closed box 119 via a bearing, and is rotatable in regular position. The upper feed roller 128 has its shaft penetrating through an up-and-down elongated long hole 129 provided on both sides of the closed box 119 so that the feed roller 128 is movable up and down, where both ends of the shaft are supported via bearings by packing members 130, 130 which make sliding contact with the outer surface of the closed box 119, and both long holes 129 are in closed state.

This upper feed roller 128 connects an air cylinder 132 to a bracket 131 that couples the two packing members 130, 130 to each other, and the upper feed roller 128 is given up and down movement by the air cylinder 132. The two feed rollers 127, 128 are driven by an appropriate drive source such as a motor via a belt transfer mechanism in opposite directions so that the feed rollers 127, 128 can be switched between high speed and low speed.

The processing apparatus of this embodiment of the present invention is constructed as described above. Now its operation is explained with reference to FIGS. 1 to 16.

Initial state (Power switch ON)

With suction sources A, B actuated, in the pickup means 50*a*, the pickup bar 50 comes to standby at the ascent position, where the vacuum pump (not shown) is actuated so that a suction force acts on the suction hole 51 of the nozzle 106, causing the storage container 53 for the hose material X to slowly rotate. The thickness detection means 54 is opened to stand by, the holding jig 60 of the reversal means 60*a* ascends to stand by, and the feed rollers 128, 129 of the closed box 119 stop rotating, the upper roller 128 ascending to stand by. The slide pipe 120 is in the retreat position, the lid 90 is in the closed position, the shutters 21 to 33 are all in the closed state, the holed shutters 41, 43 are in the closed state and the holed shutter 42 is in the opened state.

Start switch ON

The pickup bar 50, after a descent, picks up one piece of the hose material X within the storage container 53 with the suction hole 51 of the nozzle 106. The pickup bar 50 then ascends to lift the hose material X into within the guide pipe 104.

When the hose material X is sucked up with the nozzle 106, air is jetted out through a plurality of jet holes 52 provided at the lower end of the guide pipe 104, so that other material clinging to the material, if any, is excluded.

The arrangement that material is sucked up to the suction hole 51 provided on the side face of the nozzle 106 is intended to enhance the likelihood of sucking up one piece of material at a time.

If the suction hole 51 was provided at the lower face, it would press and hold the material within the storage container 53 to make the material forcedly sucked up, which might cause two to three pieces of material to be picked up.

In contrast to this, with the suction hole 51 provided at the side face, when the nozzle 106 is lowered to within the storage container 53, the material piece closest to the nozzle 106 is sucked up by being attracted sideways, thus making it unlikely to occur that two or more pieces of material are picked up.

In connection to this, a test was performed with a multiplicity of material pieces randomly accommodated in the storage container under the same conditions, by 1000 pieces of material for each case. According to the resulting experimental data, the pickup rate of two or more pieces of material was 3% in the case where the suction hole was provided at the lower face, and 0.5% in the case where the suction hole was provided at the side face.

On the way of the ascent of the pickup bar 50, when the sensor 1 firstly detects the presence of material and subsequently detects the absence of material, the ascending speed of the pickup bar 50 changes from the up-to-now high-speed travel to a low-speed travel.

Figure 5:
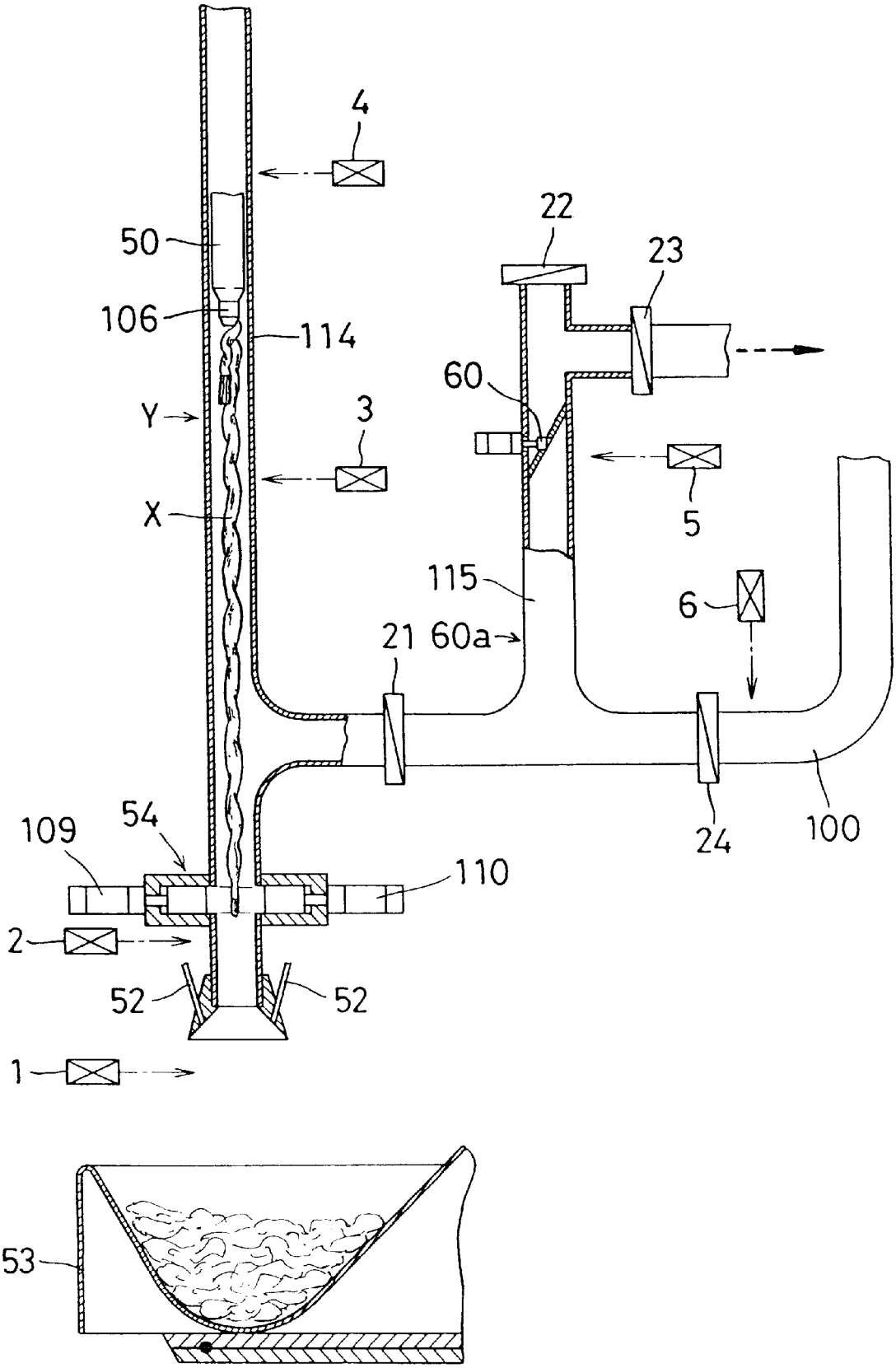
FIG. 5 is a partly cutout side view showing a normal picked-up state of material by the pickup means.

In this state, when the sensor 2 next detects an absence of material, the pickup bar 50 goes up at a further low speed and stops an end of the picked-up material at a specified position of the thickness detector 54 (FIG. 5).

More specifically, the distance h between the detection position of the sensor 2 and the specified position (detection position) of the thickness detector 54 (see FIG. 2) is a predetermined fixed distance. Therefore, by performing an control operation that the pickup bar 50 is made to ascend by the distance h after the detection by the sensor 2 and then stopping the pickup bar 50, the end (lowermost end) of the picked-up material can be reliably stopped at a specified position within the detection range of the detector 54 also thanks to the lowermost speed travel of the pickup bar 50.

Figure 6:
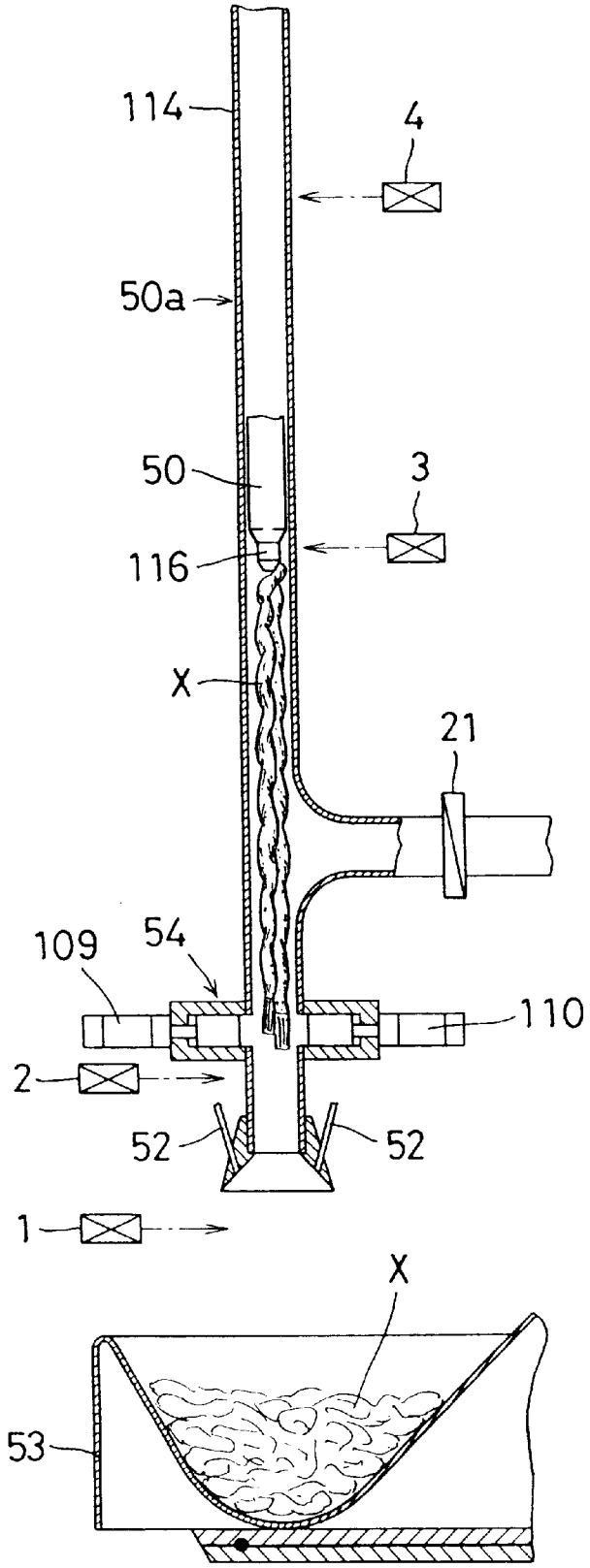
FIG. 6 is a partly cutout side view showing a picked-up state of folded-into-two material by the pickup means.
Figure 7:
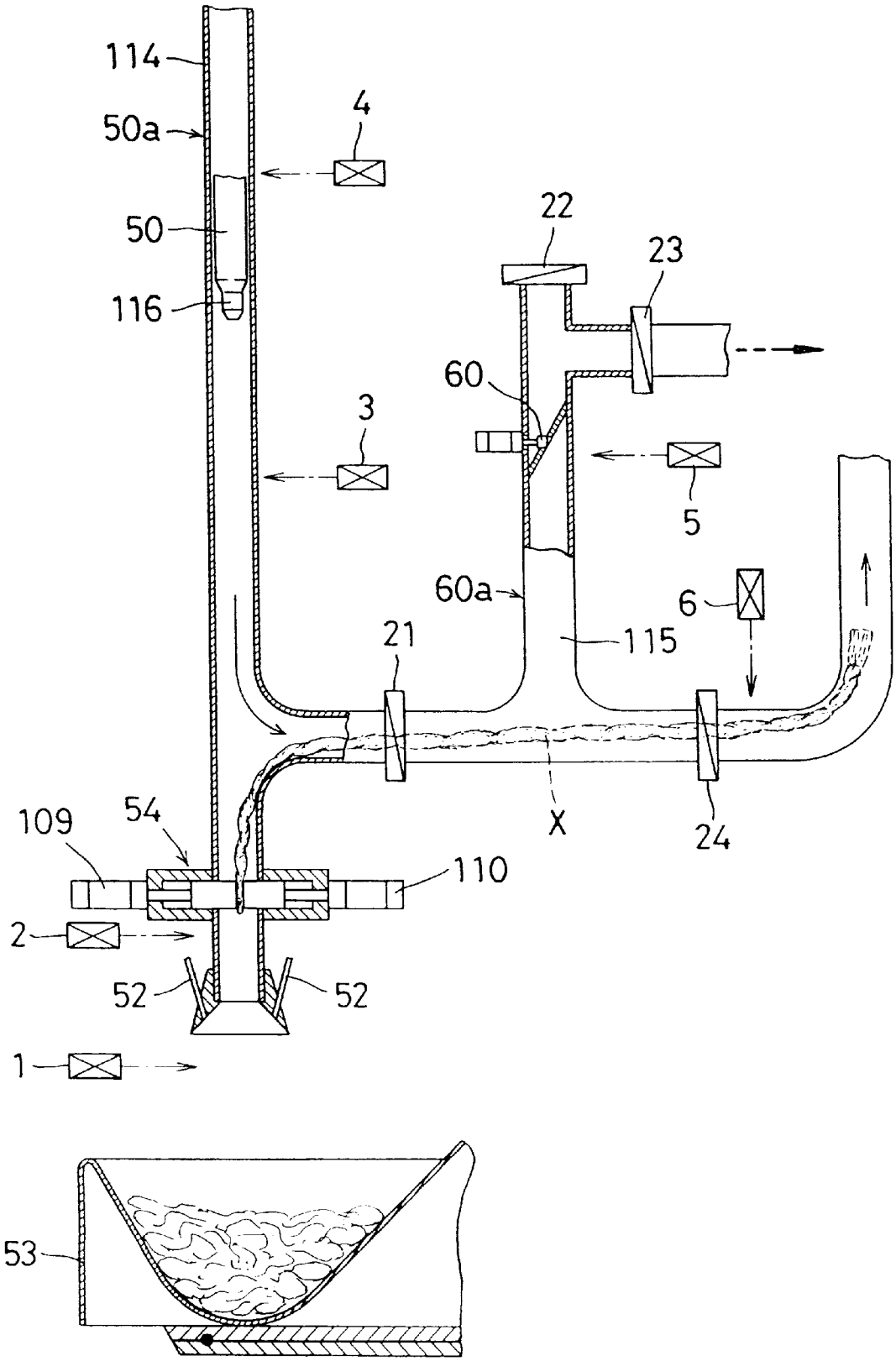
FIG. 7 is a partly cutout side view showing the relationship between the material with the welt portion at the front end and the reversal means.
Figure 8:
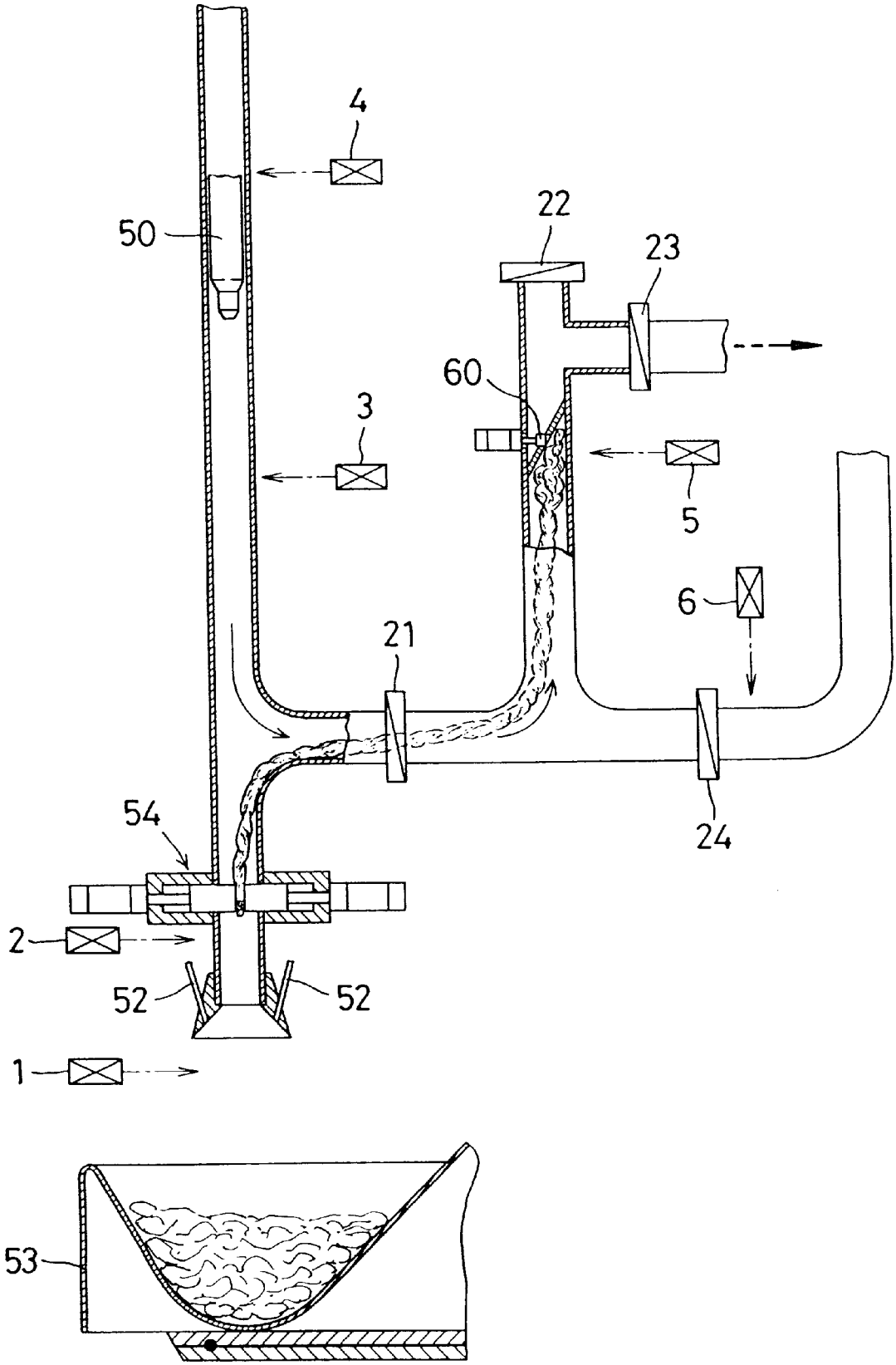
FIG. 8 is a partly cutout side view showing the relationship between the material with the toe at the front end and the reversal means.

A case where the material is picked up in a fully-folded-in-two (halved) state (see FIG. 6)

In this case, as can be understood from FIG. 6, both ends (toe portion and welt portion) of the material are held by the thickness detector 54, in which case the conveyance of material of the succeeding stage would encounter interference. Therefore, in such a state, the material has been folded in two to be shortest in its overall length, in which state when the material end has stopped at the specified position of the detector 54, the picked-up material would not be detected by the sensor 3 as shown in FIG. 6.

It is noted that this sensor 3 is adjusted in the up-and-down direction according to the kind (length) of the material.

When the picked-up material is not detected by the sensor 3, it is decided as a pickup failure, where the picking-up operation under progress is stopped and air is jetted out through the nozzle 55 provided at the lower face of the pickup bar 50, thus making the material to be dropped into the container.

Subsequently, air jet is stopped, the suction hole 51 is put into suction again, and the pickup operation is repeated.

A case where the pickup bar 50 is ascended without sucking up the material (where an idle pickup occurs)

In this case, the pickup bar 50 alone ascends (the pickup bar 50 ascends while keeping high speed because the presence or absence of material is not detected by the sensor 1), and when the pickup bar 50 has reached its uppermost standby position (position of the pickup bar 50 in FIGS. 1 and 2), the sensor 4 does not detect the presence of material, so that the pickup bar 50 starts descending again and repeats the pickup operation.

In the case where the material has been picked up normally, when the material is lifted normally into the guide pipe 104, the thickness of the material is detected by the detecting means 54. As shown in FIGS. 17 (A) through (C), the thickness is measured by the quantities of piston strokes (displacement) of two cylinders.

The piston strokes (distances) of the cylinders are preliminarily set by the teaching function or the like. Then, these set values and measured values are compared with each other by an encoder or magnet scale, by which whether it is a toe portion or a welt portion is decided.

A case where the end is decided as a toe portion

In the state of FIG. 5, the picked-up material is sucked up by its welt portion side, while the toe portion is held by the detector 54.

From the above state, the shutters 21, 24, 25 (FIG. 1) are opened, the pickup bar 50 is stopped sucking, and the air jet is started to make the shutter 25 opened, so that the suction air flow from the suction source A acts from the rising pipe to the interior of the lateral pipe, while the suction holding on the welt portion side is released. As a result, the material is conveyed to the lateral pipe into the rising pipe with the released welt portion headed (see FIG. 7), then the sensor 6 detects material, and then the holding of the toe portion by the thickness detector 54 is released, so that the material is conveyed up to the stock position through within the rising pipe and stopped at the shutter 41 (see FIG. 10).

In addition, when the sensor 7 detects material on the way of the conveyance within the rising pipe, the shutters 21, 24, 25 are closed and the shutters 21, 24 are closed, causing the path of the lateral pipe to be shut off and thus enabling the succeeding pickup operation to be started. Also, the shutter 25 is closed, causing the action of suction from the suction source A to be stopped.

A case where the end is decided as a welt portion:

In the state of FIG. 5, the picked-up material is sucked up by its toe portion side, while the welt portion is held by the detection means 54.

From the above state, the shutters 21, 23 are opened, the pickup bar 50 is stopped sucking, and the air jet is started to make the shutter 23 opened, so that the suction air flow from the suction source A acts on the front end of the lateral pipe via the reversal pipe, while the suction holding on the toe portion side is released. As a result, the material is conveyed to the lateral pipe to the reversal pipe with the released toe portion headed and stopped the stopper (see FIG. 8). Then the sensor 5 detects material, and the holding jig 60 descends to hold the toe portion, while the holding of the welt portion by the detector 54 is released, so that the material is conveyed into the reversal pipe and reserved in a bulk form by the stopper (see FIG. 9).

When the material is reserved in bulk within the reversal pipe with the toe portion headed in this way, the shutters 21, 23 are then closed and the shutters 23, 24, 25 are opened.

The closed shutter 21 causes the pickup pipe and the lateral pipe to be shut off, enabling the succeeding pickup operation to be started. The closed shutter 23 causes the sucking operation into the reversal pipe to be stopped.

The opened shutter 24 makes the lateral pipe and the rising pipe communicated with each other, while the opened shutter 25 causes a suction force to be effected into these pipes. In addition, the opened shutter 22 serves for air intake.

Figure 9:
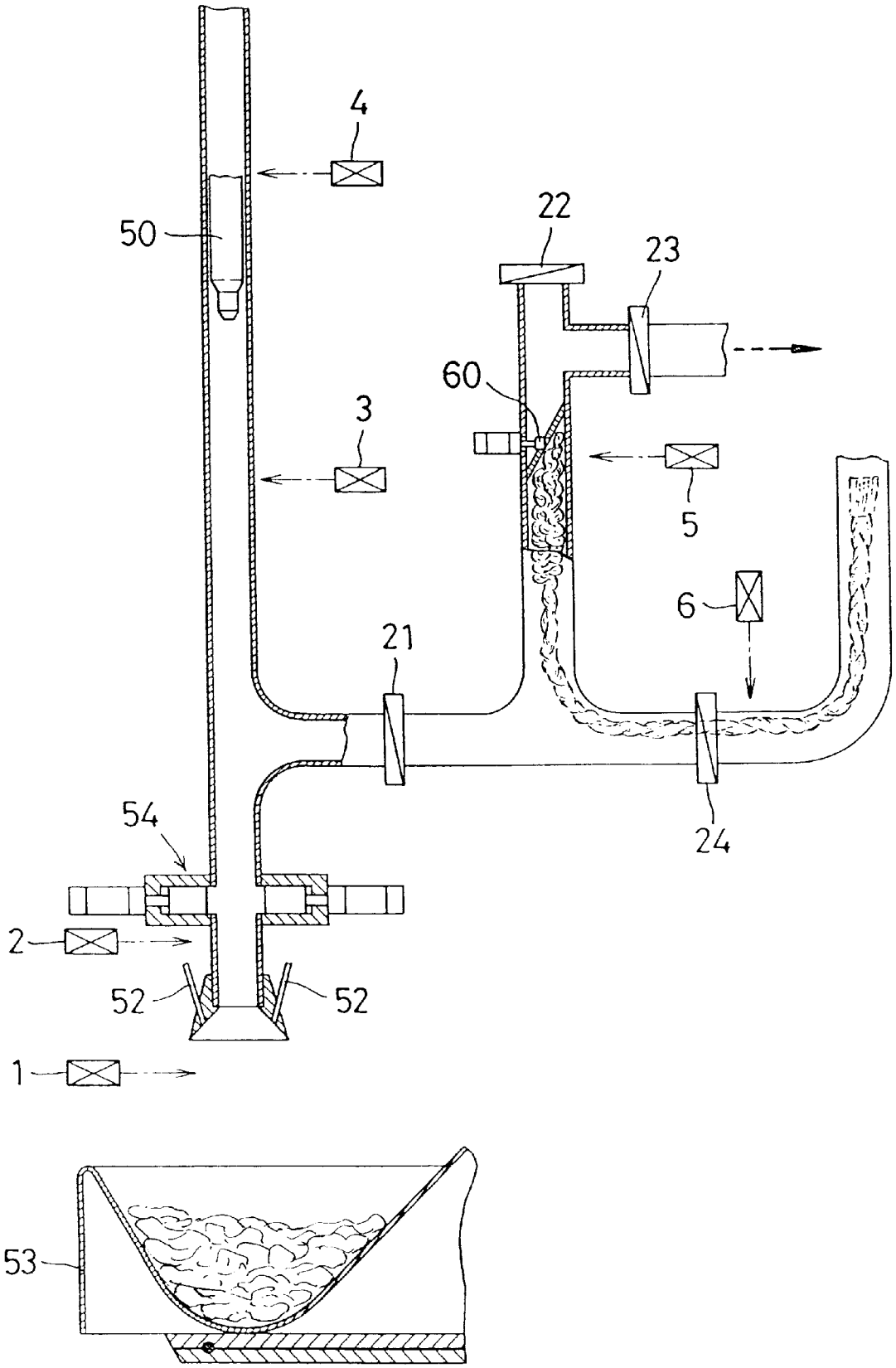
FIG. 9 is a partly cutout side view showing a reversed state of the material with the toe at the front end.

As a result of this, the material reserved in the reversal pipe is conveyed through the lateral pipe to the rising pipe, in turn with the welt portion headed (state of dot-chain line in FIG. 9). On this way of conveyance, the sensor 6 detects the material, the holding jig ascends back to release the holding of the material on the up-to-now toe portion side.

Figure 10:
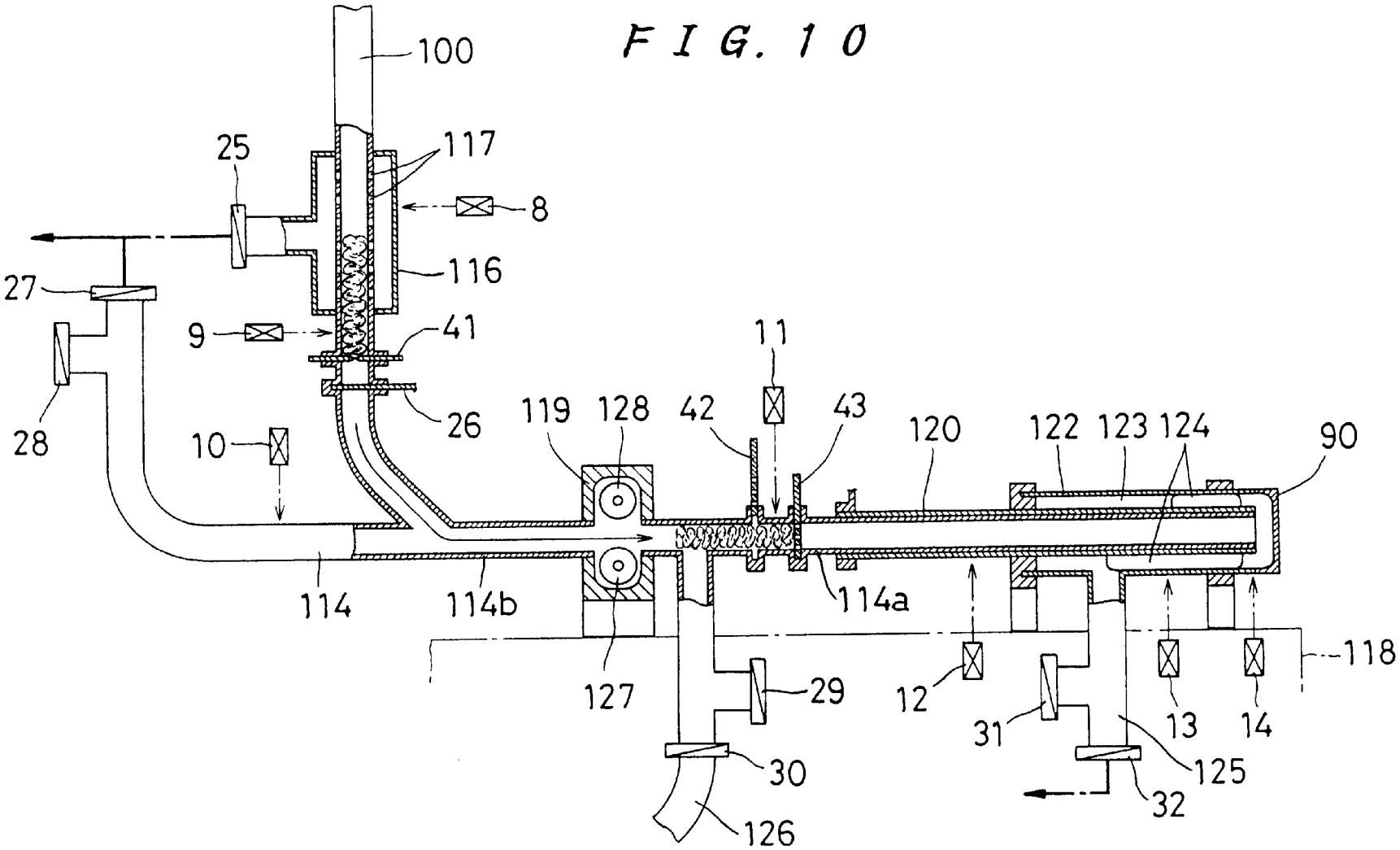
FIG. 10 is a partly cutout side view showing the relationship of the material with the stock means and the welt-portion opening mechanism.

Therefore, the material is conveyed up to the stock position via the rising pipe with the welt portion headed, and stopped by the shutter 41 (see FIG. 10).

In addition, on the way of conveyance within the rising pipe, the sensor 7 detects the material and the shutters 22 24, 25 are closed, so that the suction is stopped.

As described above, even if the picked-up material is positioned with the welt portion headed or the toe portion headed, whichever it is, the material conveyed to the stock position is so positioned that its welt portion is necessarily headed.

The material reserved in the stock position is detected by the sensor 9.

Upon detection of the material by the sensor 9, the shutters 41, 26, 32, 28 are opened.

The opened shutter 32 causes a suction force to act on the interior of the material stretching pipe 114 through the opening pipe and the slide pipe. The opened shutter 28 serves for air intake.

As a result, the opened shutters 41, 26 cause the material reserved at the stock position to be conveyed into the material stretching pipe 114 with the welt portion headed, and stopped by the shutter 43 (state of dot-chain line in FIG. 10).

In addition, for the opening of the shutters 41 and 26, the shutter 26 is first fully opened and then the shutter 41 is gradually opened (both-side opened), so that the material can be conveyed into the material stretching pipe 114 reliably in correctly headed position (with the welt portion headed) while being prevented from one-sided conveyance.

Figure 11:
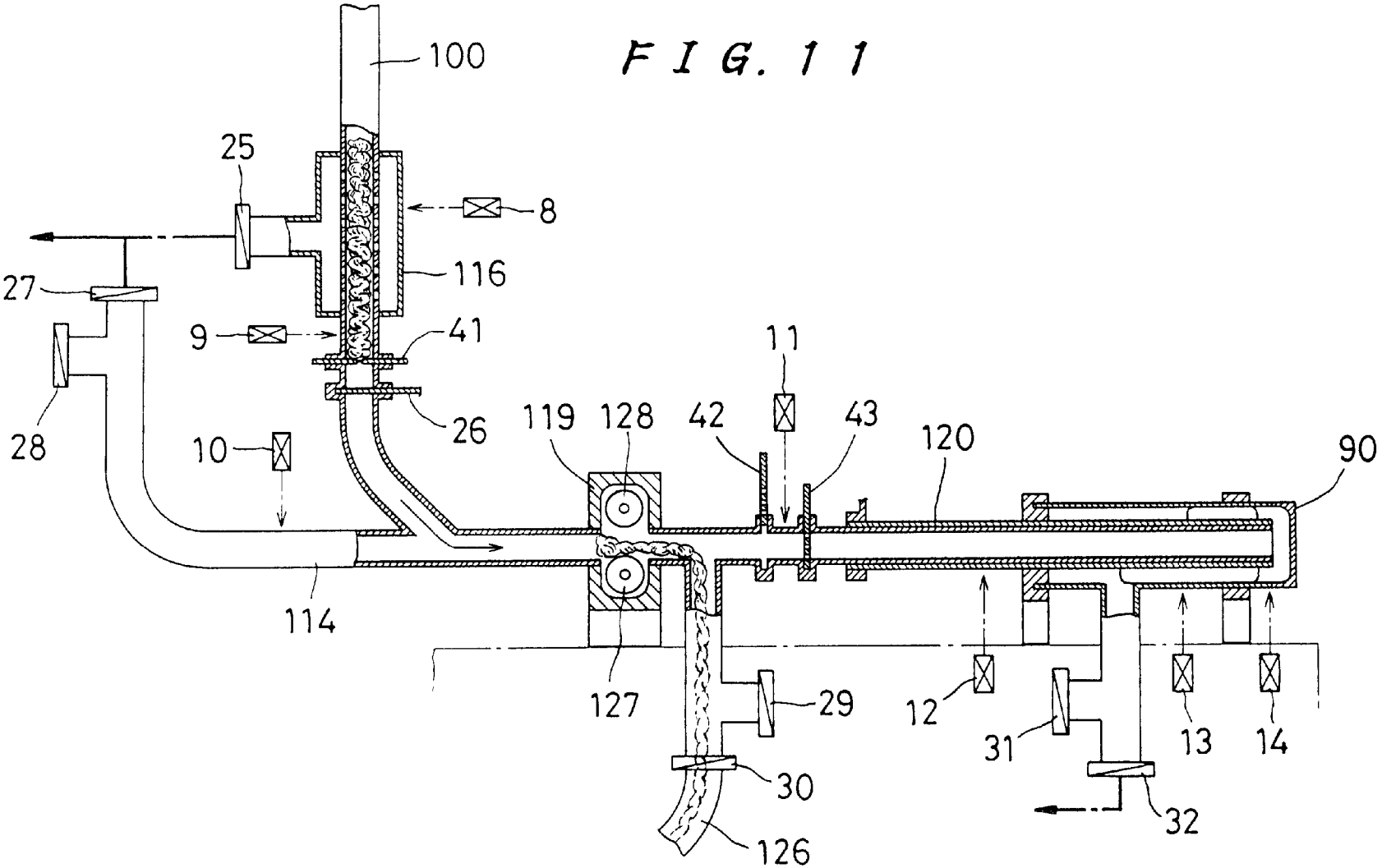
FIG. 11 is a partly cutout side view showing a state of discharging defect defective material.

When two pieces of material are picked up:

In this case, as shown in FIG. 11, the material reserved in the stock position is larger in quantity when present in two pieces than in one piece. Therefore, in this case, both sensors 9 and 8 detect the material, and a failure result is decided.

Upon detection of the sensors 9 and 8 as shown above, the shutters 41, 26, 28, 30, 33 are opened so that the opened shutters 30, 33 cause a suction force to act from the material stretching pipe 114 to the discharge pipe side, by which the two pieces of material are discharged from the stock position to the container through the material stretching pipe 114 and the discharge pipe as shown by dot-chain line in FIG. 11. After the discharge of material, the shutters 41, 26, 28, 30, 33 are closed again.

When the material is stopped by the shutter 43, the material is detected by the sensor 11. The detection by the sensor 11 causes the shutters 42, 41, 26, 32, 28 to be closed, and the shutters 27, 29 to be opened.

The closed shutter 42 holds the material that has been stopped at the shutter 43, by a portion on the welt portion side. Then, the opened shutters 27, 29 cause a suction force in the opposite direction to act on the material stretching pipe 114.

In addition, the opened shutter 29 serves for air intake.

Figure 12:
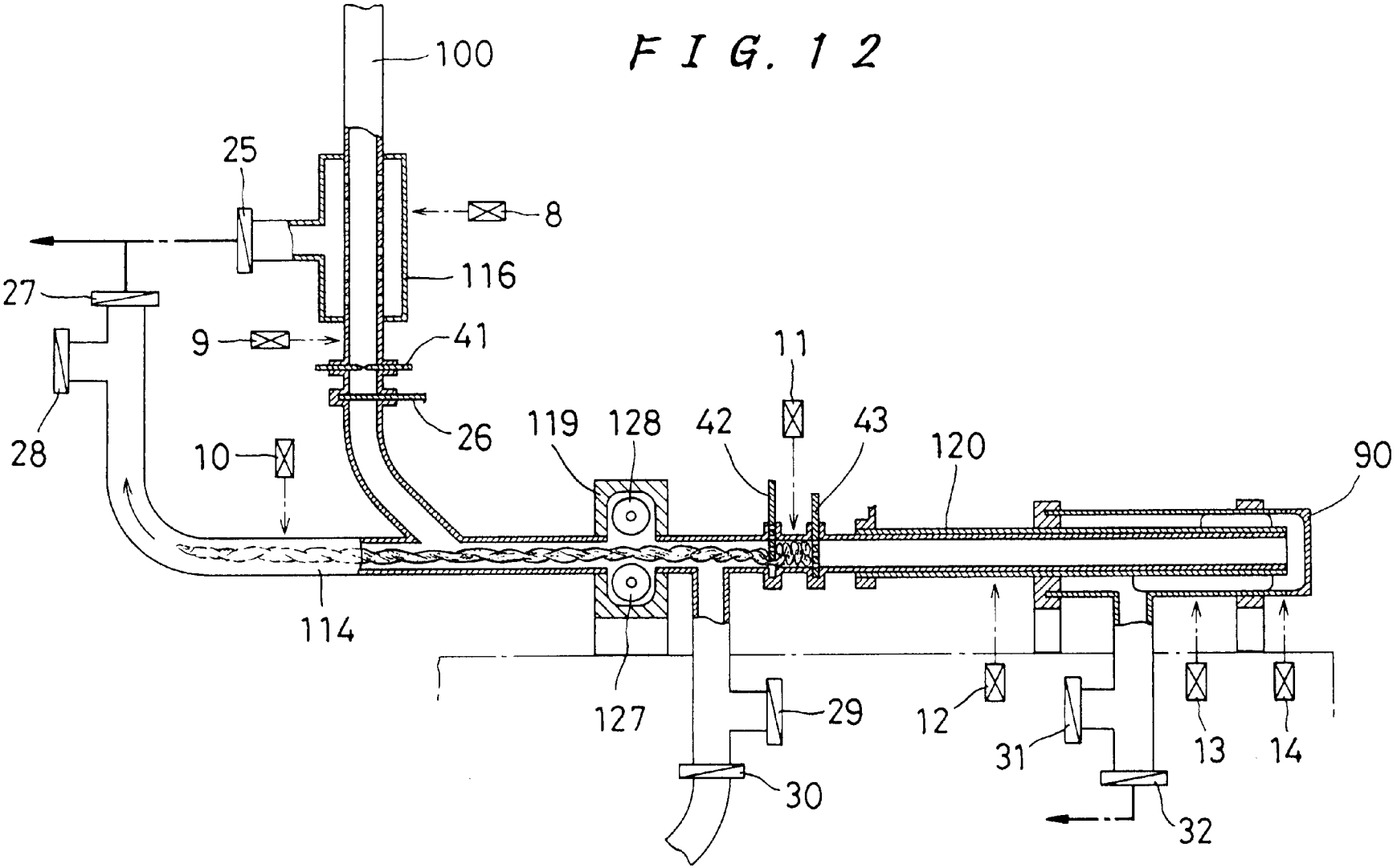
FIG. 12 is a partly cutout side view showing a stretched state of material.

As a result, the material stopped at the shutter 43 is held at a near portion by the shutter 42, while the rest of the material is stretched by suction force backward of the material stretching pipe 114 with the toe portion headed (see FIG. 12).

When the material is stretched backward of the material stretching pipe 114, the material is detected by the sensor 10.

The detection by the detection sensor 10 causes the roller 128 to descend and pinch the material against the roller 127, and besides causes these rollers to rotate. Synchronously with this, the shutters 42, 43 and the shutter 32 are opened.

Figure 13:
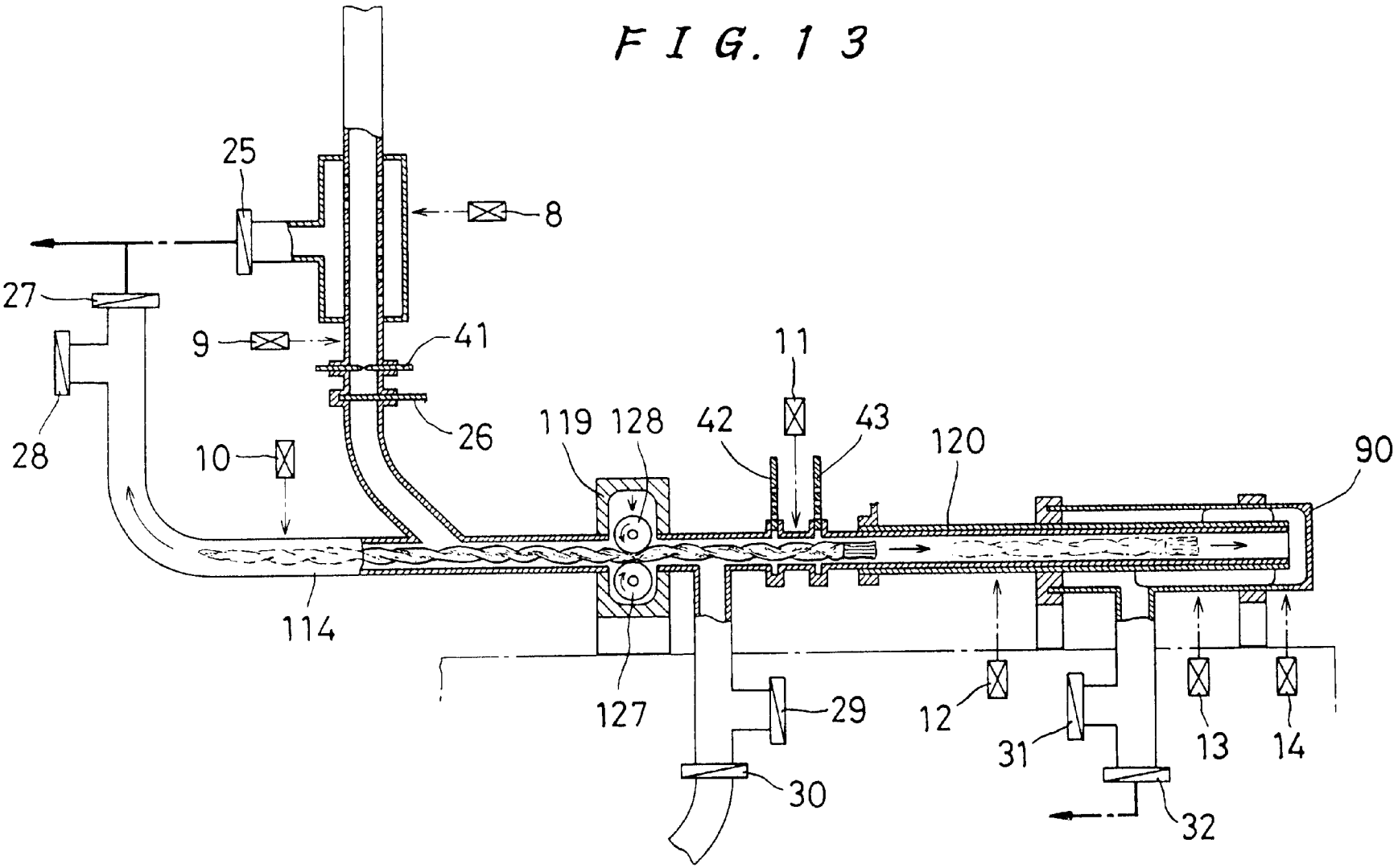
FIG. 13 is a partly cutout side view showing a state during the feed of the material for the welt-portion opening mechanism.

The opened shutters 42, 43 release the holding of the material, and moreover put the material stretching pipe 114 into a communicated state. Besides, the opened shutter 32 causes a suction force from the front side of the material stretching pipe 114 to act again through the opening pipe and the slide pipe. In this operation, a suction force acts also on the rear side of the material stretching pipe 114, so that the material is held at its near central portion by the rollers 128, 127 as shown in FIG. 13. As a result, the welt portion is sucked up toward the front side of the material stretching pipe 114 and the toe portion is sucked up toward the rear side of the material stretching pipe 114, respectively.

From the above state, the material is forcedly conveyed forward of the material stretching pipe 114 by the rotating action of the rollers 128, 127. On the way of the conveyance, upon detection of the material by the sensor 12, the rotation of the rollers is reduced in speed a low speed (one third of the initial speed), and then, upon detection by the sensor 13, the rotation of the rollers is further reduced in speed to a micro-low speed (to one tenth of the initial speed), in which state the welt portion of the material is conveyed toward the front end side of the material stretching pipe 114 (state of FIG. 13).

Figure 14:
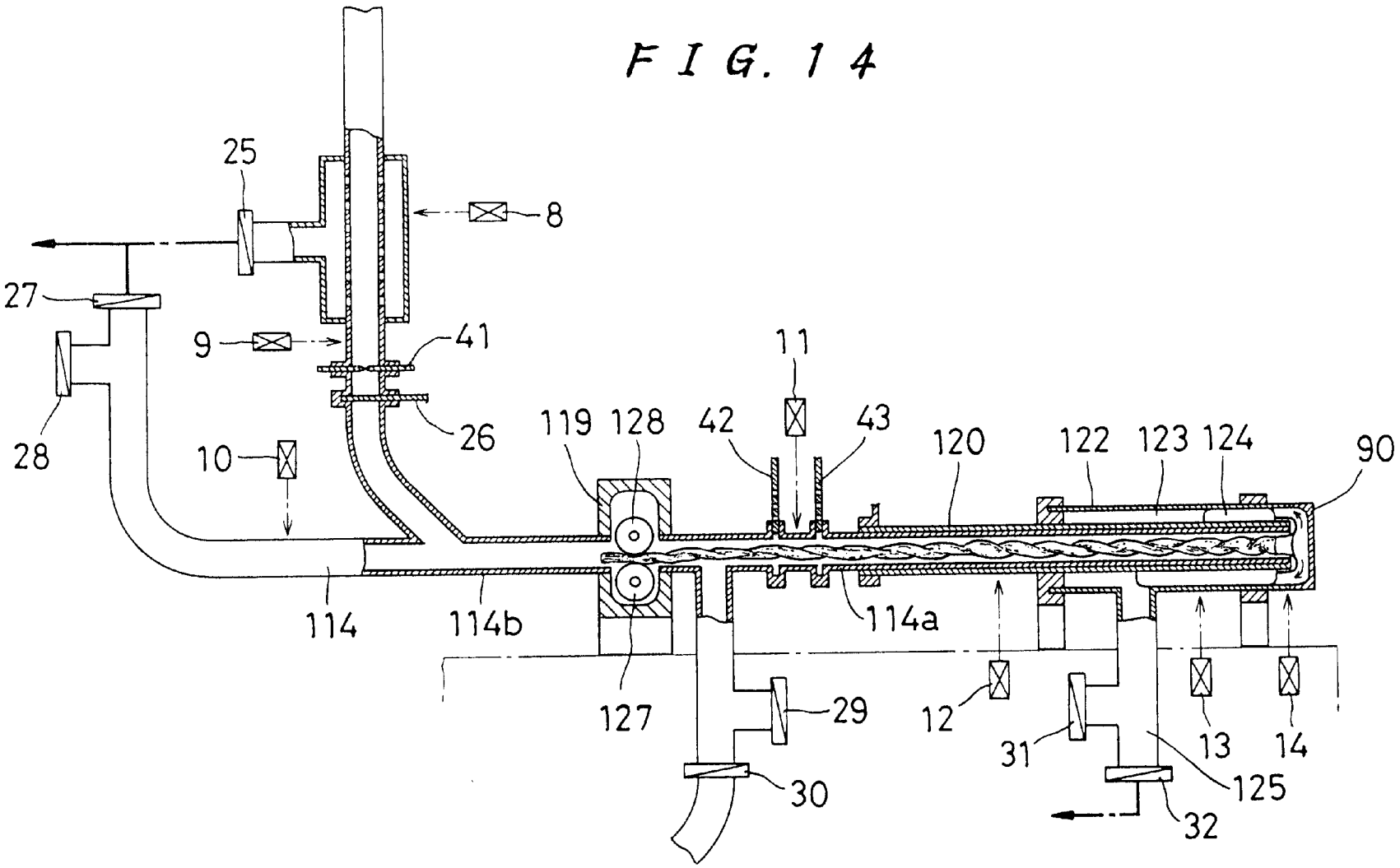
FIG. 14 is a partly cutout side view showing an opened state of the welt portion.

Over these steps, when the welt portion of the material is conveyed to the front end portion of the material stretching pipe 114, the welt portion is then unfolded onto the slide pipe while being opened, as if it were a flower blooming, by a suction air flow acting between the slide pipe and the opening pipe, where the suction air flow is acting evenly on the circumference (see FIG. 14).

Now that the welt portion has been unfolded on the slide pipe, the welt portion is detected by sensors 14 (three to four sensors 14 are placed equidistantly on the circumference, where a detection by all the sensors is decided as a good unfolding while no detection even by one sensor is decided as a faulty unfolding).

When all the sensors have detected the material, the shutters 32, 29, 29 are closed to stop the action of the suction force derived from the front and rear of the material stretching pipe 114, and also stop the rotation of the rollers, and further make the upper roller 128 ascend back, thereby releasing the pinching of the material.

Figure 15:
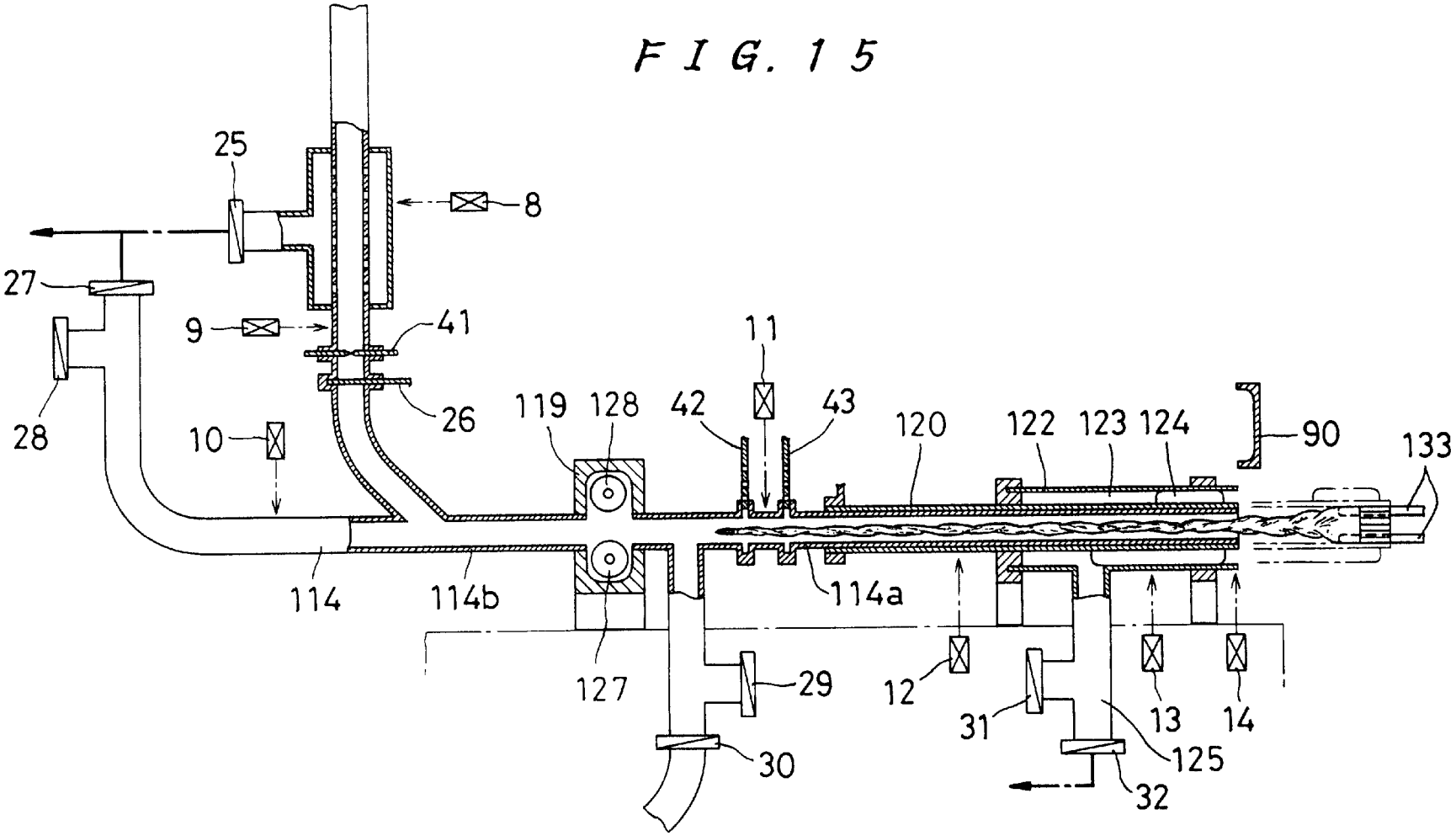
FIG. 15 is a partly cutout side view showing a state of material delivery.

Next, the lid 90 is opened and then the slide pipe 120 is advanced, so that the welt portion of the material unfolded onto the slide pipe is delivered to a claw 133 of the insertion device that has been standing there (see FIG. 15).

Now that the material has been delivered to the claw and that the rest of the material has been removed from the material stretching pipe 114, the slide pipe retreats back, and the lid 90 is closed and the shutter 43 is closed, thus returning to the initial state.

Upon decision of a faulty unfolding of welt portion

The shutters 32, 29, 29 are closed, the rotation of the rollers is stopped, the roller 128 ascends and the shutters 30, 33, 31 are opened.

Figure 16:
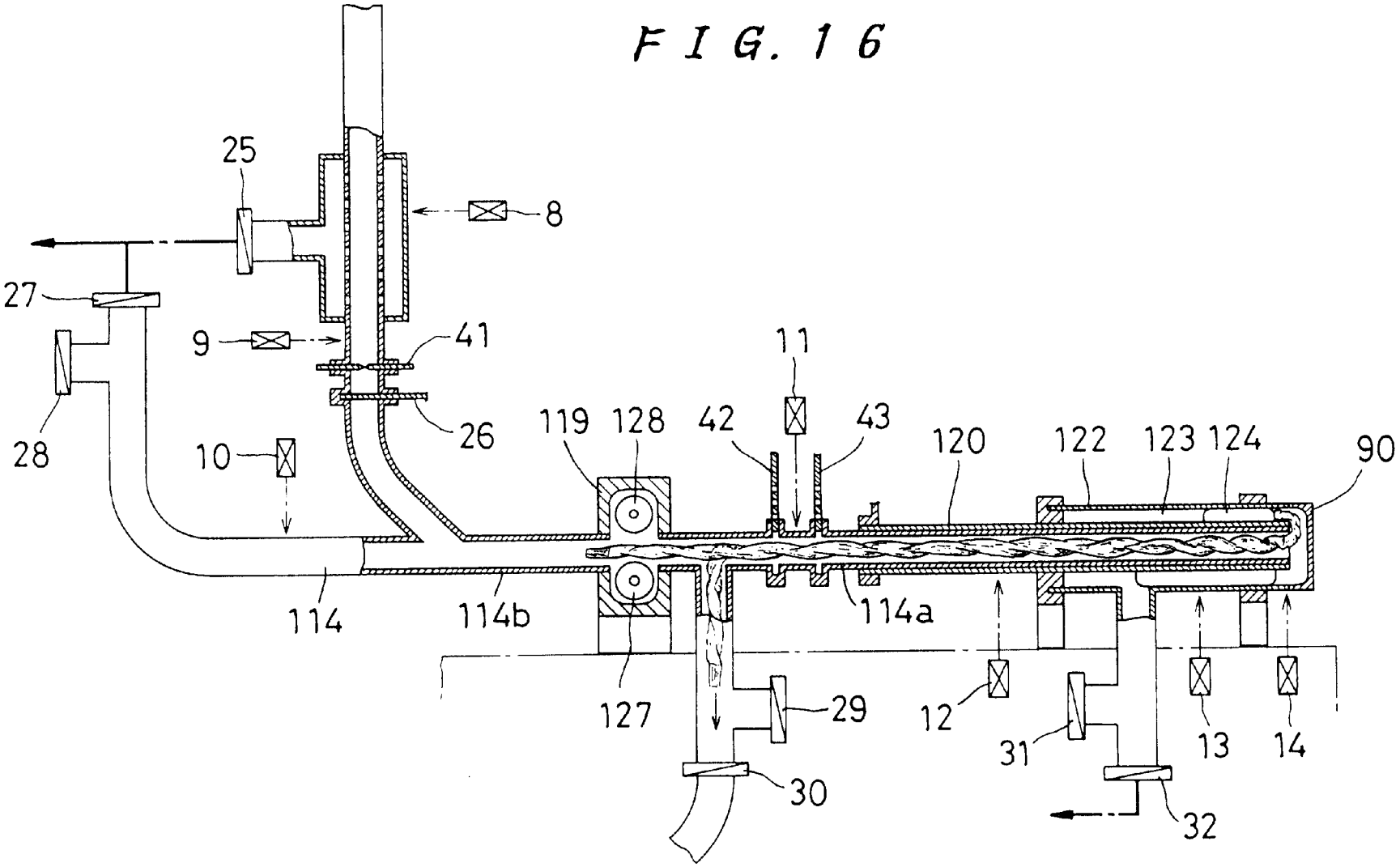
FIG. 16 is a partly cutout side view showing a state of response to a mis-opening of the welt portion.

The opened shutters 30, 33 cause the suction force to act within the discharge pipe so that the material present within the material stretching pipe 114 is returned to the container through within the discharge pipe (see FIG. 16).

The shutter 31 serves for air intake. After the discharge of the material, the shutters 30, 33, 31 and the shutter 43 are closed, thus returning to the initial state.

Hereinbelow, a second embodiment of the present invention is described with reference to FIGS. 19 through 35.

Figure 19:
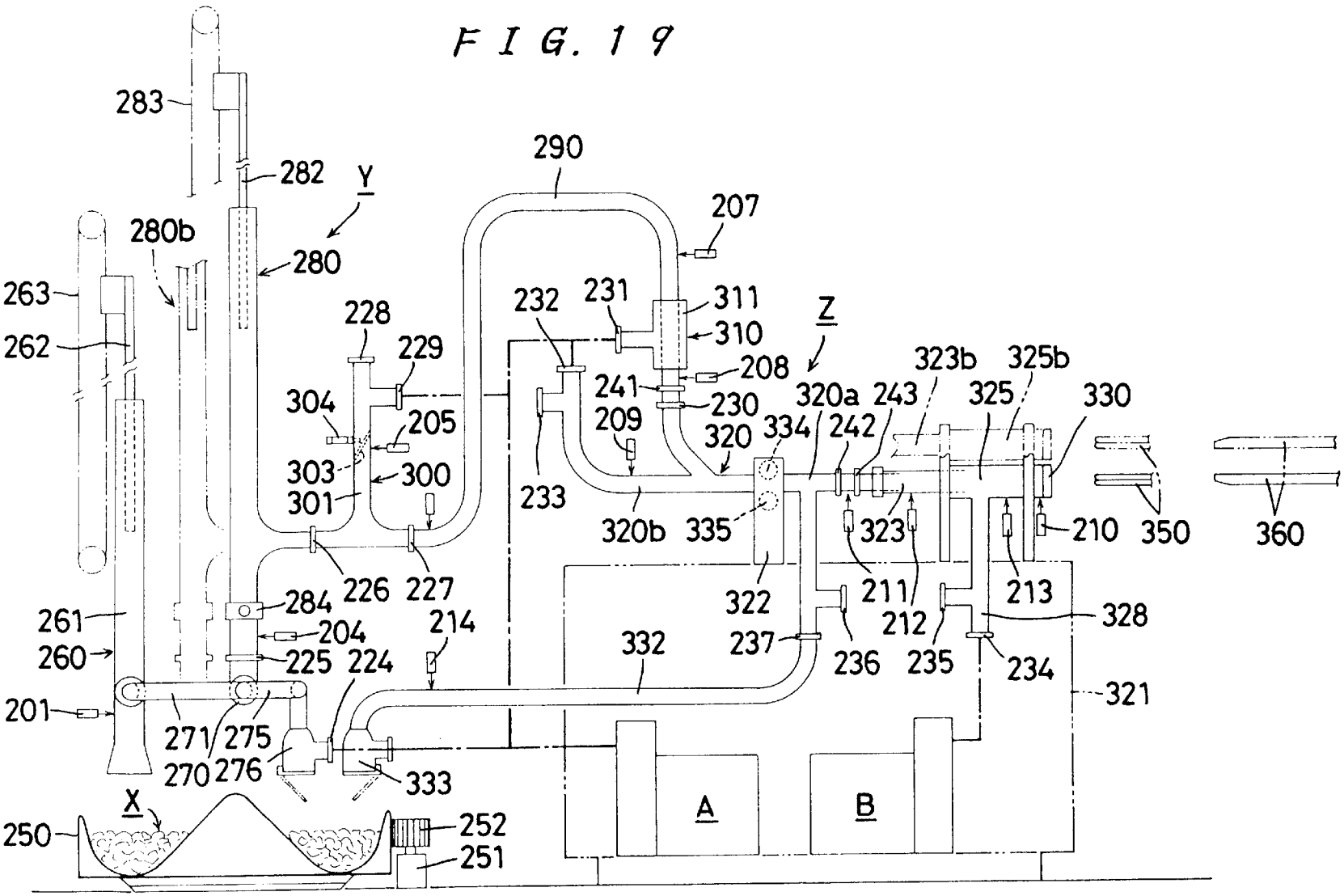
FIG. 19 is a side view showing the structure of the whole processing apparatus according to a second embodiment of the present invention.
Figure 20:
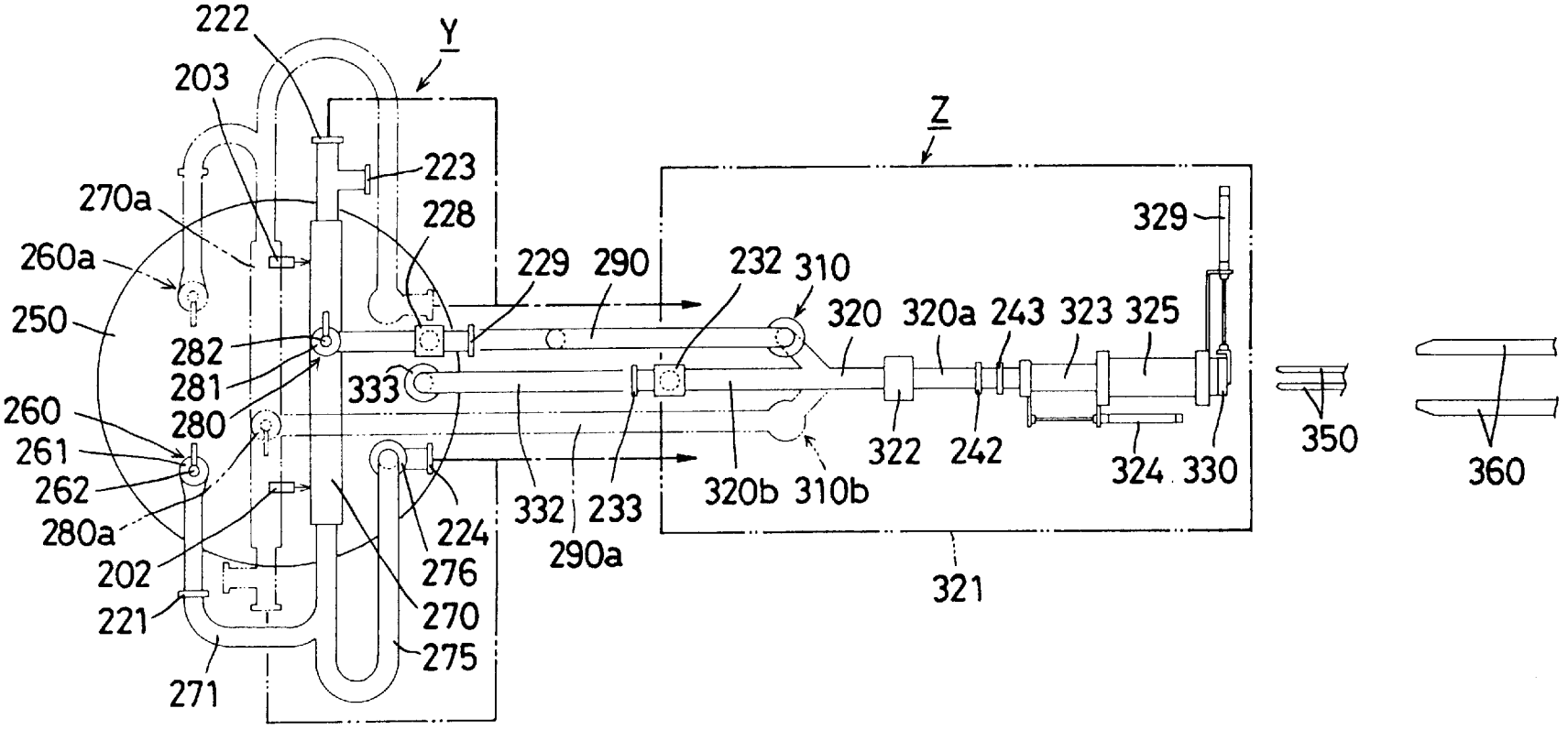
FIG. 20 is a plan view of the same.

FIGS. 19 and 20 show the whole construction of a processing apparatus for hose material. This processing apparatus comprises a feed-posture control mechanism Y for hose material X in a former-stage step, and a welt-portion opening mechanism Z in a latter-stage step. The feed-posture control mechanism Y comprises a storage container 250 for randomly storing a multiplicity of hose material pieces X, a first pickup mechanism 260 placed just above the storage container 250, a flat-lay passage 270 provided laterally in a communicated state with the first pickup mechanism 260, a second pickup mechanism 280 connected to the flat-lay passage 270 in an upright state, a transport pipe 290 branched and connected to the second pickup mechanism 280, reversal means 300 provided in proximity to the second pickup mechanism 280 on the way of the pipe 290, and stock means 310 provided on the downstream side of the transport pipe 290.

The storage container 250 is continuously rotated at low speed in one direction by a roller 252 of a motor 251 which makes sliding contact with an outer circumferential surface of the storage container 250. The first pickup mechanism 260 is so constructed that a long guide pipe 261 elongated in the up-and-down direction with its lower end enlarged in diameter into a taper shape is vertically fixed just above the storage container 250, where a pickup bar 262 housed within the guide pipe 261 is coupled to an endless belt 263 and driven by a reversible servo motor so that the pickup bar 262 moves up and down so as to be position-controllable.

A lower end of the pickup bar 262 is formed into a truncated-conical shape (see FIG. 21), and a suction hole (not shown) provided at its lower end face or slanted front-end side face is connected to a vacuum pipe and, as required, via piping. In addition, a sensor 201 for detecting the hose material X is placed on the downside of the guide pipe 261.

Figure 21:
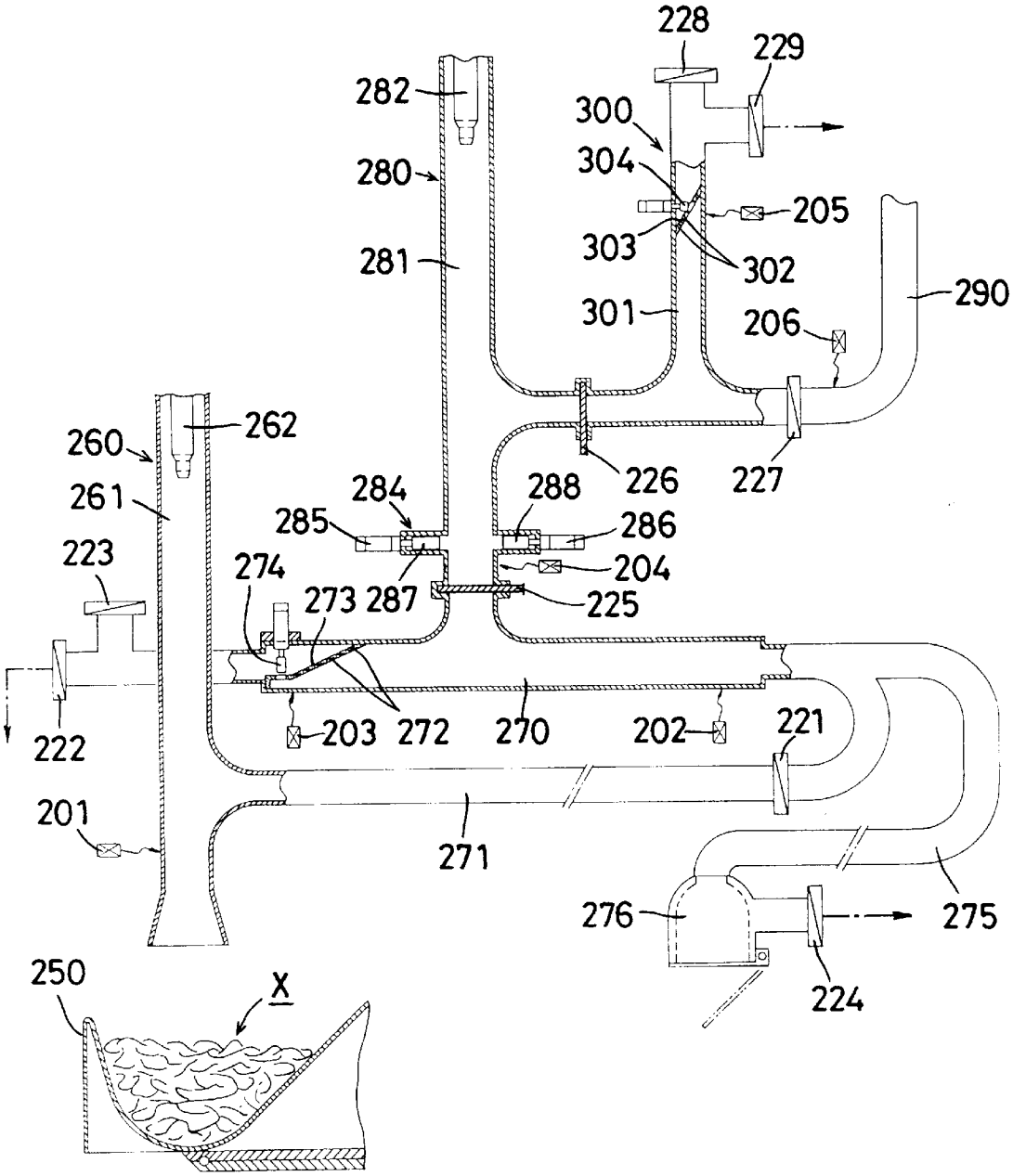
FIG. 21 is a partly sectional side view showing details of the hose material feed-posture control mechanism in the same embodiment.

The flat-lay passage 270 is formed of a laterally provided longitudinal cylindrical body as shown in FIG. 21. A conveyance pipe 271 branched and connected to the guide pipe 261 is communicated and connected to one end side of the flat-lay passage 270 via a shutter 221, while a material blocking plate 273 with a multiplicity of small air holes 272 bored and a material holding jig 274 are provided on the other side. Besides, the flat-lay passage 270 is connected to a suction source A via a opening/closing shutter 222 and can be communicated with and shut off from outside air via a shutter 223.

Referring to the flat-lay passage 270, sensors 202, 203 for detecting the hose material X are placed on both sides of the flat-lay passage 270, while a discharge pipe 275 for the hose material X is connected to one end side of the flat-lay passage 270 sided to the conveyance pipe 271.

Referring to the discharge pipe 275, a discharge valve 276 for the hose material X is connected at a terminal portion of the discharge pipe 275 so as to confront above the storage container 250. The discharge valve 276 is connected to the suction source A via a shutter 224.

The second pickup mechanism 280 has a guide pipe 281 communicated with and connected to the flat-lay passage 270 via a shutter 225 in an upright state, and a pickup bar 282 is housed in the guide pipe 281 Then, this pickup bar 282, like the pickup bar 262 of the first pickup mechanism 260, is coupled to an endless belt 283 and driven by a reversible servo motor so that the pickup bar 282 moves up and down. Besides, a suction hole (not shown) connected to the vacuum pipe is provided at its lower end face.

At a lower end of the guide pipe 281 of the second pickup mechanism 280, is provided a detection means 284 for detecting whether the lower end of the hose material X sucked up by the pickup bar 282 and lifted from the flat-lay passage 270 is a toe portion or a welt portion, depending on the thickness.

This detection means 284 is so arranged, as shown in FIG. 21, that cylinders 285, 286 are placed so as to sandwich the center shaft of the guide pipe 281 therebetween and that pinching jigs 287, 288 are provided to piston rods of the cylinders 285, 286. While the travel stroke of one cylinder 285 is made constant, piston travel of the other cylinder 286 is measured by an encoder or magnet scale, by which the thickness difference of the welt portion or the toe portion is detected by pinching them with the two pinching jigs 287, 288.

For example, if the stroke of the two cylinders 285, 286 is 25 mm, it is preliminarily set (taught) that when one cylinder 285 is moved over the entire stroke while the other cylinder 110 is moved with a portion of the material thickness left, a resulting travel of not less than 24 mm (corresponding to a thickness of not more than 1 mm) is determined as a toe portion of thin thickness as shown in FIG. 17 (B), and a resulting travel of not more than 23.9 mm (corresponding to a thickness of not less than 1.1 mm) is determined as a welt portion. This setting may be set arbitrarily depending on the kind of the hose material X.

A sensor 204 for detecting the hose material X is placed between the detection means 284 of the guide pipe 281 and the shutter 225.

At a position in lower part of the guide pipe 281 and just above the detection means 284, the transport pipe 290 for sucking up and conveying the hose material X lifted into the guide pipe 281 by an ascent of the pickup bar 282 is branched and connected to the guide pipe 281. On this transport pipe 290, the reversal means 300 is provided on the way of the transport pipe 290 and the stock means 310 is provided at a terminal end of the transport pipe 290. The transport pipe 290 is then connected to a halfway point of a material stretching pipe 320 in the welt-portion opening mechanism Z.

Referring to the reversal means 300, a reversal pipe 301 is connected thereto at a position between opening/closing shutters 226, 227 provided on the way of the transport pipe 290 as shown in FIG. 21, while opening/closing shutters 228, 229 are provided at an upper end and an upper side face of the pipe 301, and further a material blocking plate 303 having a multiplicity of small air holes 302 and a material holding jig 304 are provided on the way of the reversal means 300. Also, sensors 205, 206 for material detection are placed at places outside an intermediate portion of the reversal pipe 301 and slightly downstream of the shutter 227 of the transport pipe 290, respectively, and the reversal pipe 301 is connected to the suction source A via the shutter 229.

The stock means 310 has a both-side-openable holed shutter 241 and an opening/closing shutter 230 provided at terminal portions of the transport pipe 290 as shown in FIGS. 19 and 21. An outer cylinder 311 is externally fitted to the upstream side of these, and a multiplicity of suction holes 312 are provided at a region covered with the outer cylinder 311 of the transport pipe 290, where the outer cylinder 311 is connected to the suction source A via an opening/closing shutter 231. Further, sensors 207, 208 for detecting the hose material X are placed on the upstream and downstream sides of the outer cylinder 311, respectively.

Figure 22:
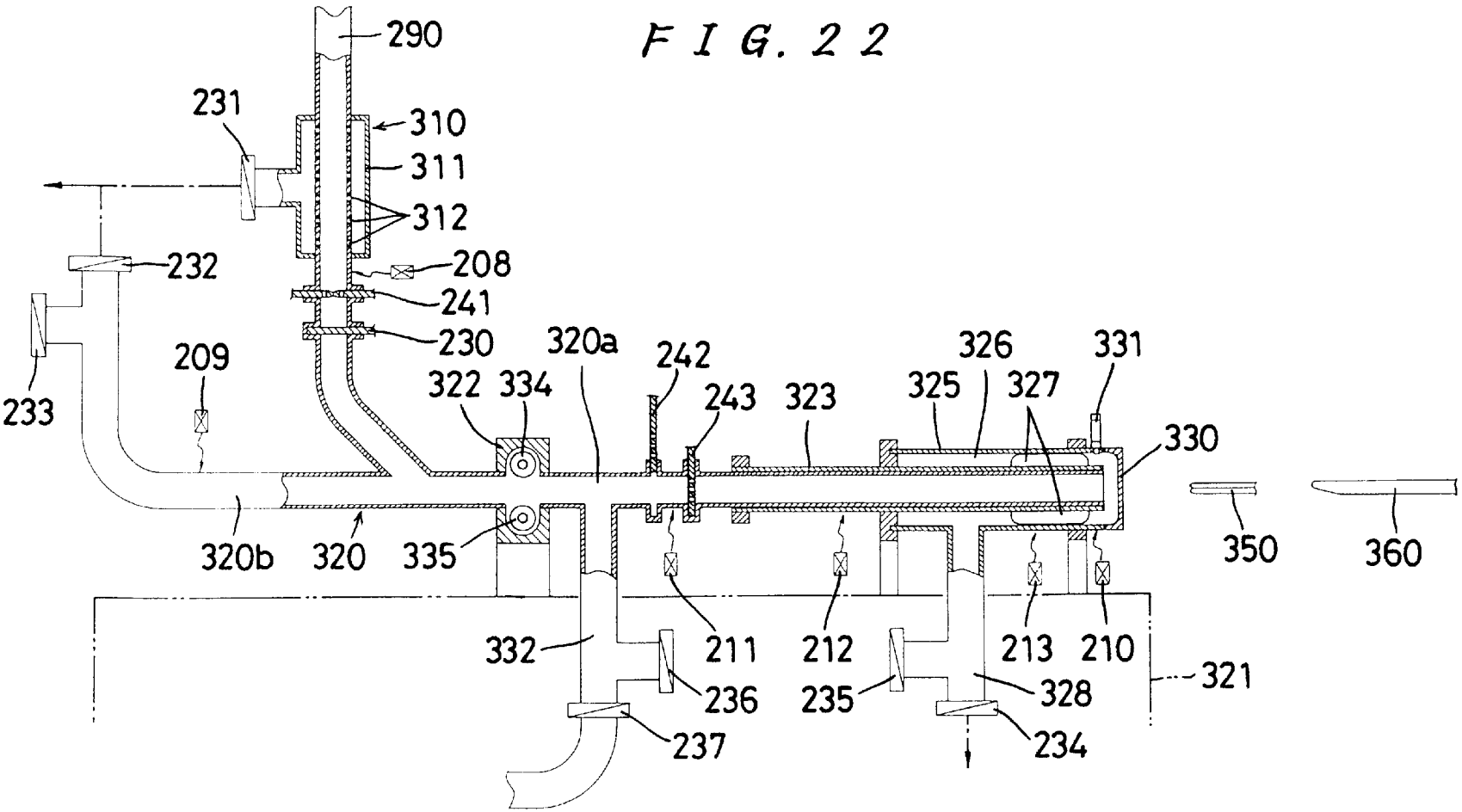
FIG. 22 is a partly sectional side view showing the welt-portion opening mechanism of the same embodiment.

Next, the construction of the welt-portion opening mechanism Z is explained. Referring to FIGS. 19, 20 and 22, in the welt-portion opening mechanism Z, the material stretching pipe 320 installed horizontal on a rack 321 is divided into a front pipe 320*a* and a rear pipe 320*b* by a closed box 322 provided on the way of the material stretching pipe 320, where the transport pipe 290 is connected to a halfway point of the rear pipe 320*b*, a rear end of the rear pipe 320*b* is connected to the suction source A via a shutter 232 and the rear end side face of the rear pipe 320*b* can be communicated with and shut off from outside air via a shutter 233. A detection sensor 10 for hose material X is placed outside the rear pipe 320*b*.

A slide pipe 323 is externally fitted to outside of the front pipe 320*a* so as to be movable axially. The slide pipe 323 is given back-and-forth movement by a cylinder 324 so that the front end of the slide pipe 323 moves in a specified stroke forward from a retreat position where the end coincides with the front end of the front pipe 320*a*.

A large-diameter pipe 325 is provided by being externally fitted at a position outside the slide pipe 323 and closer to its front end and in such a fixed placement as to be coaxial with the front pipe 320*a*. A suction passage 326 with its rear end side closed is formed between the inner diameter of the large-diameter pipe 325 and the slide pipe 323, and a plurality of fins 327 provided radially on the slide pipe 323 are provided radially on the front end side of the suction passage 326, so that the suction passage 326 is subdivided by these fins 327.

Halfway on the large-diameter pipe 325, a suction pipe 328 connected to a strong suction source B is connected so as to communicate with the suction passage 326, and the front end of this large-diameter pipe 325 is opened at the position of the front end of the front pipe 320*a*. This opening can be opened or closed by a lid 330 which is actuated by a cylinder 329.

Thus, by subdividing the suction passage 326 with a plurality of fins 327, a suction air flow that acts on the passage 326 via the suction pipe 328 acts evenly on the interiors of the subdivisions of the passages 326 in the entire outer periphery of the slide pipe 323. As a result of this, the welt portion of the hose material X also expands in the same direction at the front end portion of the slide pipe 323, i.e., outward as if it were a bud blooming of a flower, thus being sucked up while opened by being fully unfolded on the outer periphery of the front end portion of the slide pipe 323.

Figure 23:
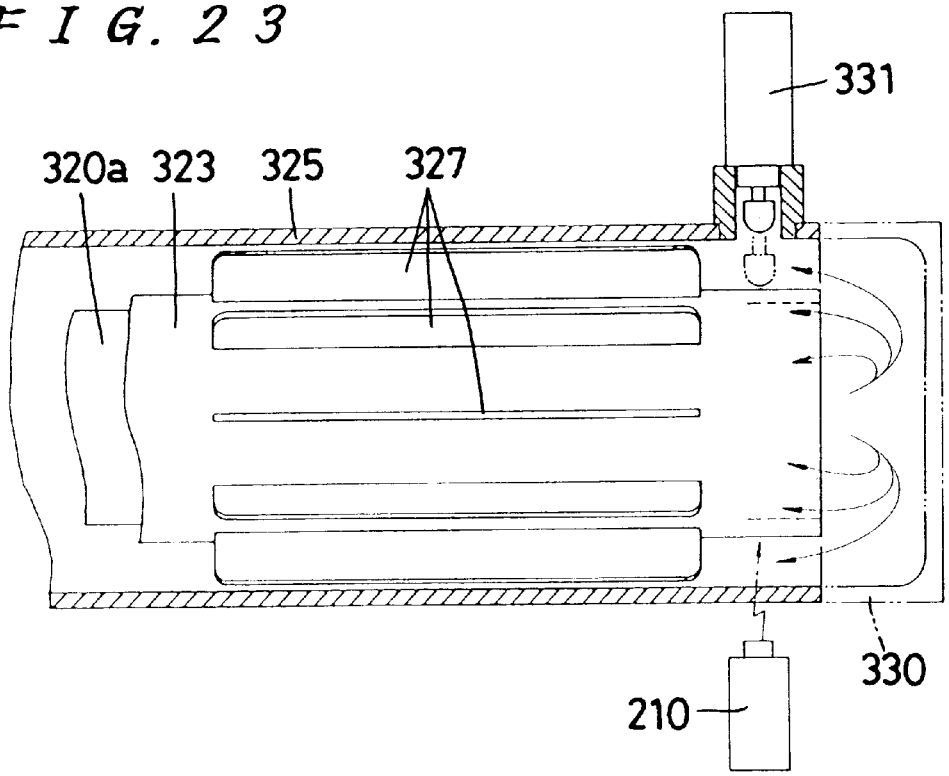
FIG. 23 is an enlarged side view showing the relationship between sliding pipe and large-diameter pipe.
Figure 24:
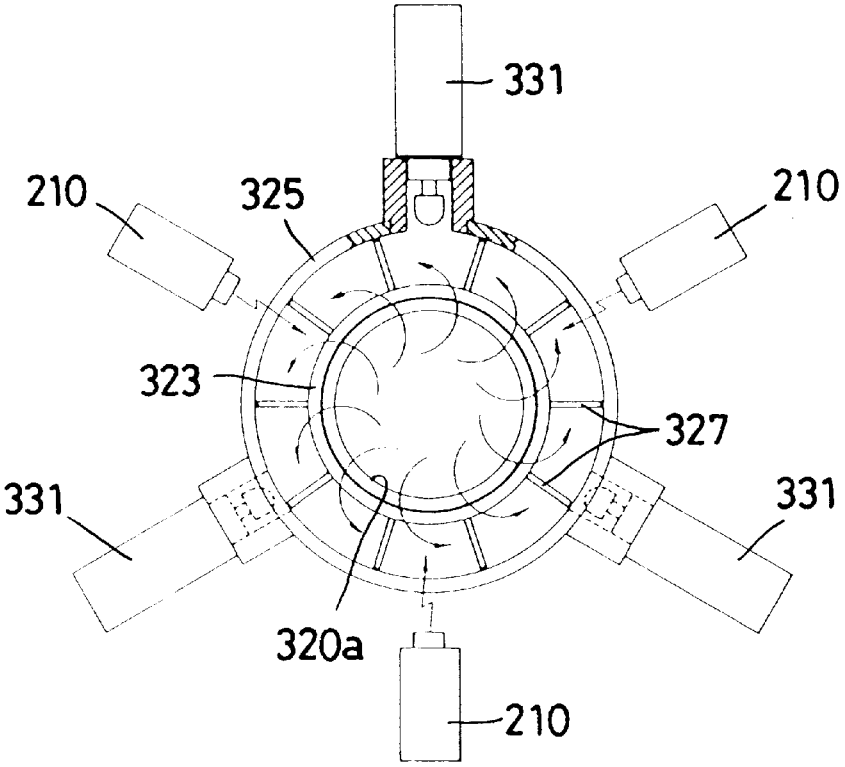
FIG. 24 is a front view of the same.

A sensor 210 for detecting this unfolded welt portion, and a pinching jig 331 for temporarily pinching the welt portion unfolded by the detection of the sensor 210 are placed in a plurality of sets (each three sets in the second embodiment) circumferentially equidistantly on the outer periphery of the front end of the large-diameter pipe 325 as shown in FIGS. 23 and 24.

In addition, sensors 211, 212, 213 for material detection are placed outside the large-diameter pipe 325 and the slide pipe 323.

The suction pipe 328 is connected to the suction source B of exclusive use via a shutter 234 and can be switchably communicated with and shut off from outside air with a shutter 235.

Halfway of the front pipe 320*a*, holed shutters 242, 243 are provided between the closed box 322 and the slide pipe 323, and a discharge pipe 332 is connected. Shutters 236, 237 are provided at a halfway root-sided place and a side place of the discharge pipe 332, respectively. An end portion of the pipe 332 is connected to the suction source A via a discharge valve 333 and a shutter 238 as shown in FIG. 9, where a detection sensor 214 for detection of the hose material X is provided on the way of the pipe 332 closer to the end portion.

Within the closed box 322, a pair of upper-and-lower feed rollers 334, 335 using wear-resistant rubber material are provided. These rollers 334, 335 are supported by appropriate drive means so as to be contactable with and separable from each other, and besides driven in opposite directions by a rotational drive means such as a motor so as to be switchable between high speed and low speed.

The processing apparatus for hose material in the second embodiment of the present invention is constructed as described above. Next, its operation is explained with reference to FIGS. 19 through 35.

First in the initial state of the apparatus (at power-ON), with suction sources A, B actuated, the pickup bars 262, 282 of the first and second pickup mechanisms 260, 280 are in the ascent position, where the vacuum pump (not shown) is actuated so that a suction force acts on the suction holes of the bars 262, 282, causing the storage container 250 for the hose material X to slowly rotate. The holding jig 274 of the flat-lay passage 270 ascends to stand by, the pinching jigs 287, 288 of the thickness detection means 284 are opened to stand by, the holding jig 304 of the reversal means 300 ascends to stand by, and the feed rollers 334, 335 of the closed box 322 are at a stop of rotation in a mutually separated state. The slide pipe 323 is in the retreat position, the pinching jigs 331 provided at the front end of the large-diameter pipe 325 ascend to stand by, the lid 330 is in the closed position, the shutters 221 to 238 are all in the closed state, the holed shutters 241, 243 are in the closed state and the holed shutter 242 is in the opened state.

Subsequent to the above initial state, when the start switch is turned ON, the pickup bar 262 of the first pickup mechanism 260 first descends, sucking up the hose material X placed in the storage container 250 with the suction holes (not shown) of the bar 262, and after the sucking-up, the bar 262 ascends to pick up the hose material X into the guide pipe 261.

For the pickup of the hose material X by the pickup bar 262, if the suction holes were provided at the lower face of the pickup bar 262, they would press and hold the material within the storage container 250 to make the material forcedly sucked up, which would often cause two to three pieces of material to be picked up.

In contrast to this, with the suction holes provided at the side face of the front end portion of the pickup bar 262, when the bar 262 is lowered to within the storage container 250, the material piece closest to the front end portion of the bar 262 is sucked up by being attracted sideways, thus reducing the probability that two or more pieces of material are picked up. Yet, the probability does not become zero.

Therefore, in the second embodiment of the present invention, even if two or more pieces of material are picked up by the pickup bar 262, those material pieces are conveyed, as they are, to the flat-lay passage 270 of the succeeding step, and one piece of material is left on the flat-lay passage 270 while the other excessive material pieces are excluded and returned to within the storage container 250.

The hose material X picked up to within the guide pipe 261 by an ascent of the pickup bar 262 is then detected at its lowermost end portion by the sensor 201 during the ascent of the bar 262. As a result, the bar 262 stops ascending, and places the picked-up hose material X to a specified position in the guide pipe 261 (state of solid line in FIG. 25).

Figure 25:
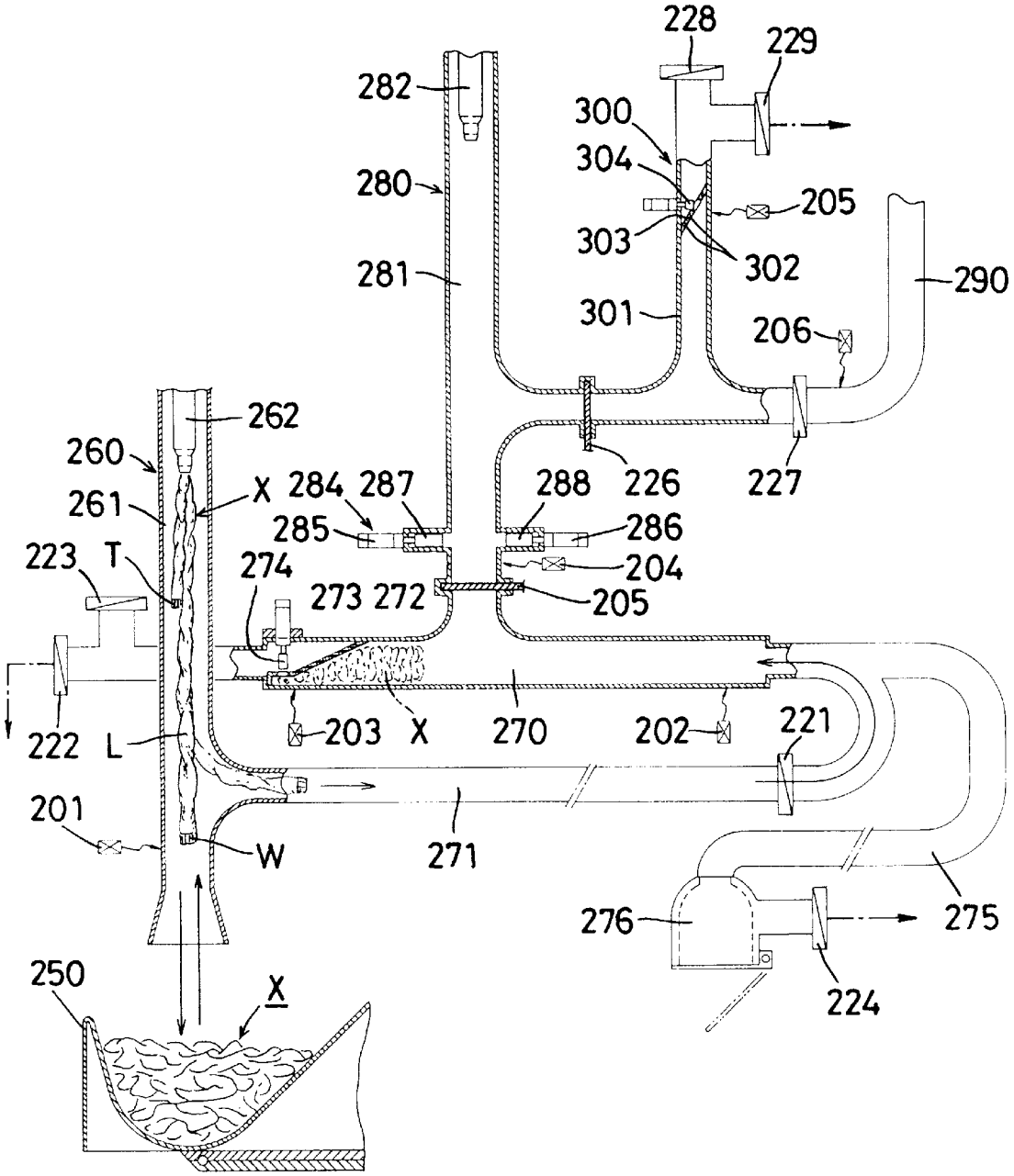
FIG. 25 is a partly sectional side view showing a picked-up state of material by the first pickup means as well as a state of the material that has been conveyed to the flat-lay passage.

As to the detection of material by the sensor 201, the shutters 221 and 222 are opened, causing a suction force from the suction source A to act on the interior of the conveyance pipe 271 through the flat-lay passage 270, so that the hose material X picked up into the guide pipe 261 is sucked up from its lowermost end portion into the conveyance pipe 271 (state of dot-chain line in FIG. 25). At this point, by stopping the sucking operation of the pickup bar 262, the hose material X sucked up at its lowermost the portion into the conveyance pipe 271 is separated from the pickup bar 262, and suctionally conveyed up to the one end side of the flat-lay passage 270 through the pipe 271, and reserved in a bulk form by the blocking plate 273 (state of dot-chain line in FIG. 25).

When the hose material X is reserved in bulk by the blocking plate 273 of the flat-lay passage 270, the reserved material is detected by the sensor 203. By this detection, the holding jig 274 first descends, the shutters 221, 222 are then closed and the shutters 223, 224, 25 are opened.

The descending holding jig 274 holds an end of the material that has first reached the end of the blocking plate 273. The closed shutter 221 enables the succeeding pickup operation (pickup from the storage container 250) of the hose material X by the first pickup mechanism 260, and the closed shutter 222 shuts off the sucking force from the suction source A that has acted from the conveyance pipe 271 toward the blocking plate 273. Then, the opened shutter 223 introduces outside air into the flat-lay passage 270, and the opened shutter 224 causes the suction force from the suction source A to act on the interior of the flat-lay passage 270 through the discharge valve 276 and the discharge pipe 275.

As a result of this, the hose material X reserved in bulk to the blocking plate 273 of the flat-lay passage 270 is in turn hold at its one end by the holding jig 274 through the action of the effect acting toward the discharge pipe 275, while the other end of the hose material X is stretched toward the discharge pipe 275. Thus, the hose material X is laid down flat along the longitudinal direction of the flat-lay passage 270 as shown by solid line in FIG. 26.

In this case, if two or more pieces of material have been picked up and conveyed into the flat-lay passage 270, then only the one piece of material that has been held at one end by the holding jig 274 is left, and the other excessive material is returned from the discharge valve 276 into the storage container 250 via the discharge pipe 275.

Now that the hose material X conveyed into the flat-lay passage 270 has been stretched longitudinally within the passage 270 and laid down flat, an end of the material on the side on which the material has been stretched is in turn detected by the sensor 202. By this operation, the shutters 223, 224 are closed, causing the suction force from the suction source A to be shut off, and further causing the holding jig 274 to ascend back to release the holding of the hose material X.

As to the detection of the material by the sensor 202, the shutter 225 is further opened, and the pickup bar 282 of the second pickup mechanism 280 is lowered to suck up a specified portion of the one-piece hose material X laid down flat within the flat-lay passage 270 by the suction holes (not shown) of the pickup bar 282. After the pickup, the bar 282 ascends to pick up the hose material X into the guide pipe 281.

On the way of the ascent of the pickup bar 282, when the sensor 204 firstly detects the presence of material and subsequently detects the absence of material, the ascending speed of the bar 282 changes from the up-to-now high-speed travel to a low-speed travel, where the end of the material picked up into the guide pipe 281 is stopped at a specified position of the thickness detection means 284 (state of dot-chain line in FIG. 26).

More specifically, the distance between the detection position of the sensor 204 and the specified position (detection position) of the detection means 284 is a predetermined fixed distance. Therefore, by performing an control operation that the pickup bar 282 is made to ascend by the fixed distance after the detection of the absence of material by the sensor 204 and then stopping the pickup bar 282, the end (lowermost end) of the picked-up material can be reliably stopped at a specified position within the detection range of the detection means 284.

When the material end (toe portion T or welt portion W) of the hose material X is stopped at the specified position of the detection means 284 within the guide pipe 281, then the thickness of the material end is detected by the detection means 284. In this detection, the thickness is measured by the quantities of piston strokes (displacement) of the two cylinders 285, 286. That is, by a measurement in which the pinching jigs 287, 288 provided at the piston rods of the cylinders 285, 286 pinch the material end from both sides by movement of the piston rods, it is measured whether the material end is a toe portion T or a welt portion With. This measurement is achieved by preliminarily setting the piston stroke (distance) of one cylinder 286 out of the cylinders 285, 286 by the teaching function, and then by comparing these set value and measured values with each other by an encoder or magnet scale for making a decision.

A case where the end is decided as a toe portion by the detection means 284

Figure 26:
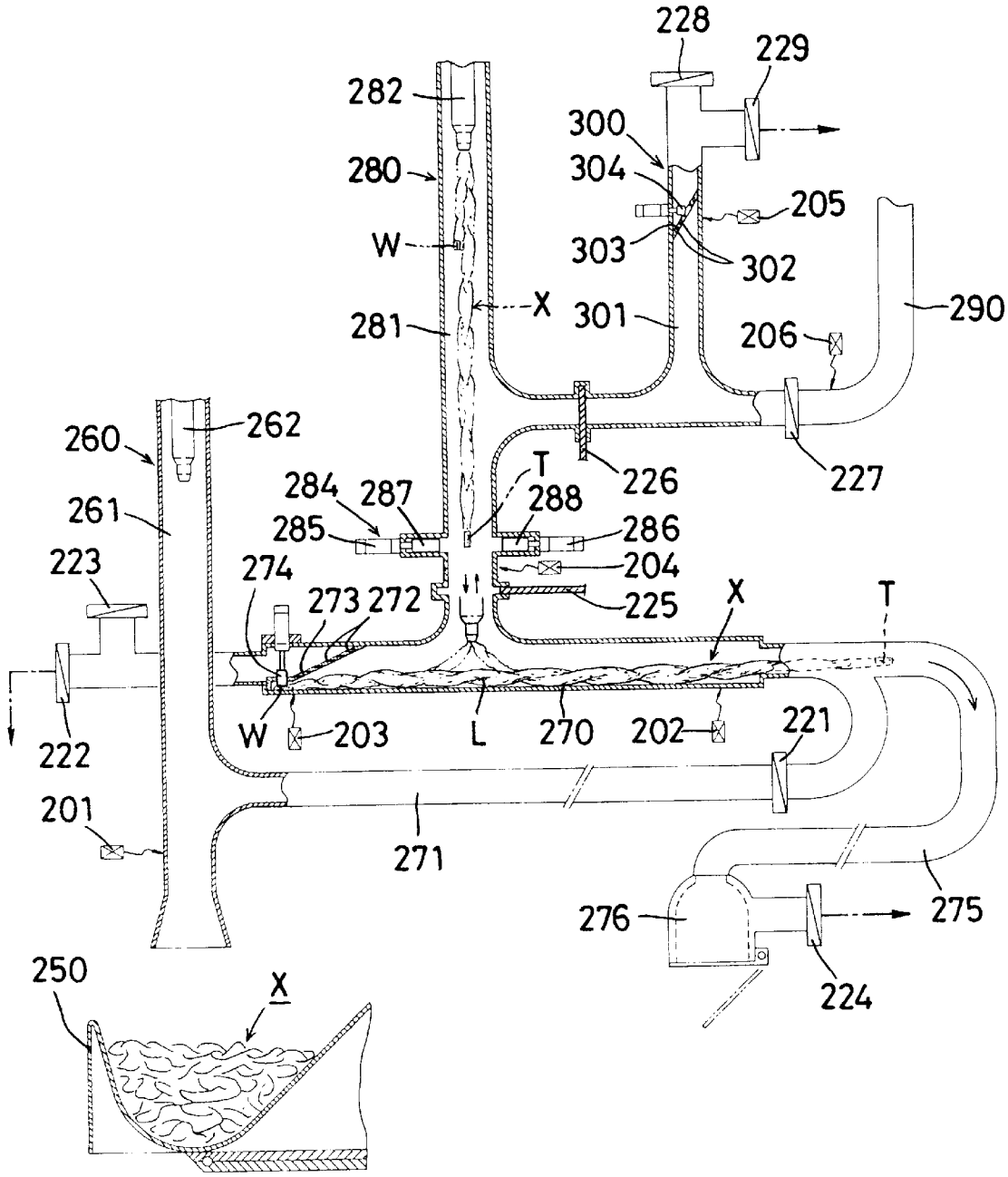
FIG. 26 is a partly sectional side view showing a state of material stretched on the flat-lay passage as well as a picked-up state of material by the second pickup means.
Figure 27:
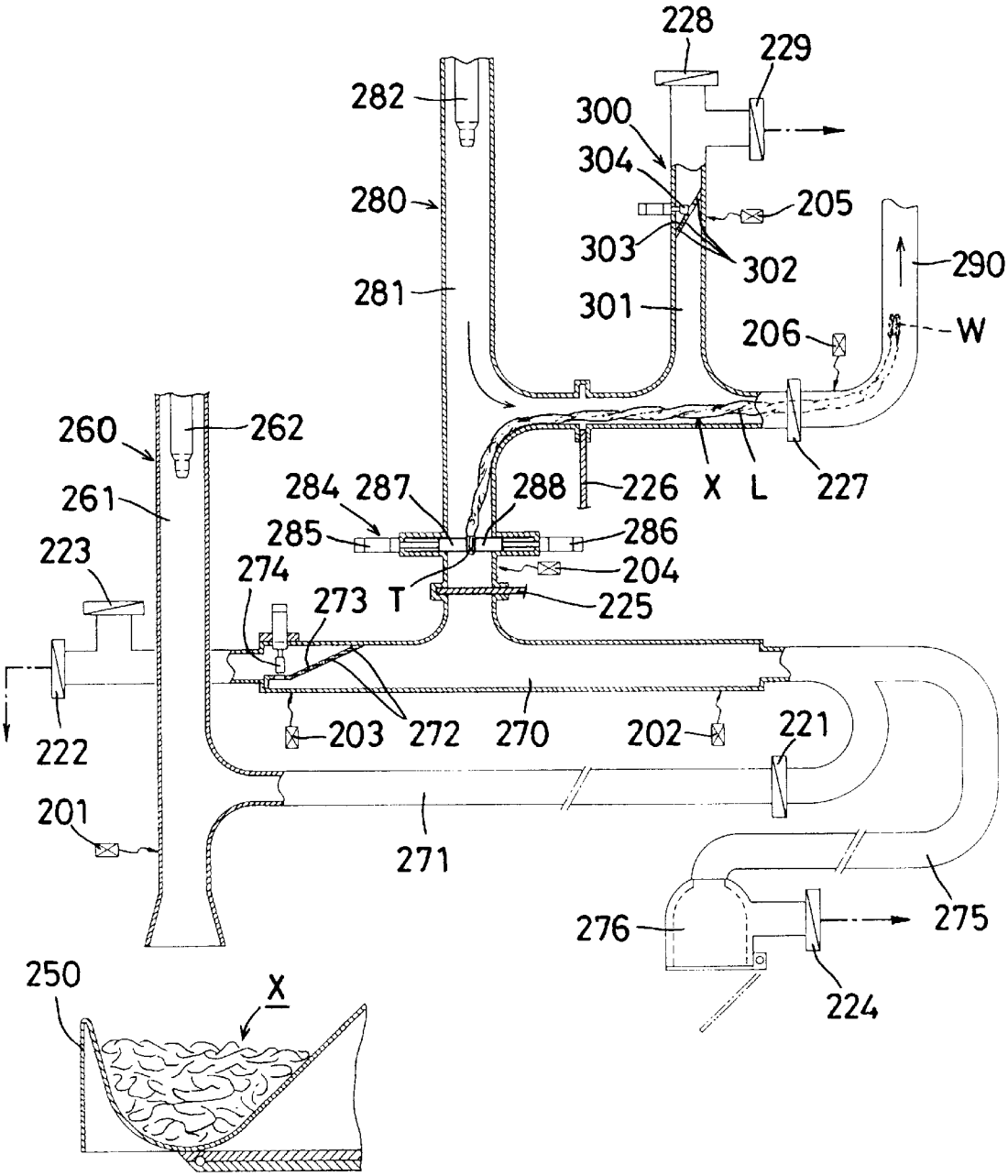
FIG. 27 is a partly sectional side view showing the relationship between the material with the welt portion at the front end and the reversal means.
Figure 28:
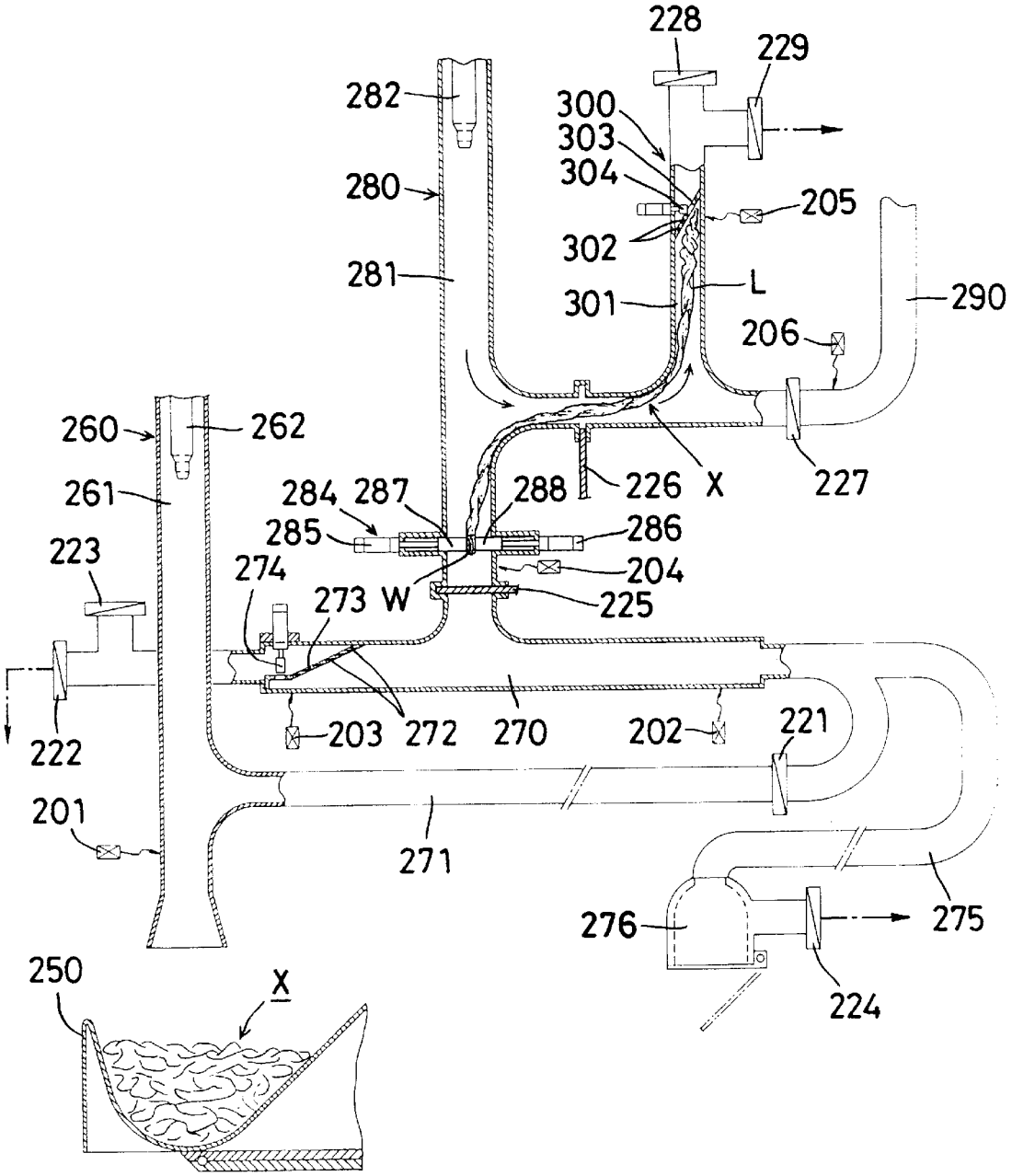
FIG. 28 is a partly sectional side view showing the relationship between the material with the toe portion at the front end and the reversal means.

In the state of FIG. 26, the hose material X picked up by the pickup bar 282 is sucked up at its leg portion L rather closer to the welt portion W, while the toe portion T forming the lowermost end is pinched by the pinching jigs 287, 288 of the detection means 284.

From the above state, the shutter 225 is closed, the shutters 226, 227 and 231 (FIG. 19) are opened, so that the suction of the pickup bar 282 is stopped.

The closed shutter 225 causes the succeeding hose material X to be conveyed into the flat-lay passage 270, enabling the flat-laying operation of the hose material X within the flat-lay passage 270 to be started. Also, the opened shutters 226, 227, 231 cause the suction force from the suction source A to act on the branch-connecting portion with the guide pipe 281 from the suction small holes 312 of the stock means 310 through the transport pipe 290, and moreover cause the suction holding on the welt portion W side by the pickup bar 282 to be released. Thus, the hose material X is sucked up into the transport pipe 290 with the toe portion T pinched by the pinching jigs 287, 288 of the detection means 284 and with the suction-released welt portion W headed (see FIG. 27).

Figure 30:
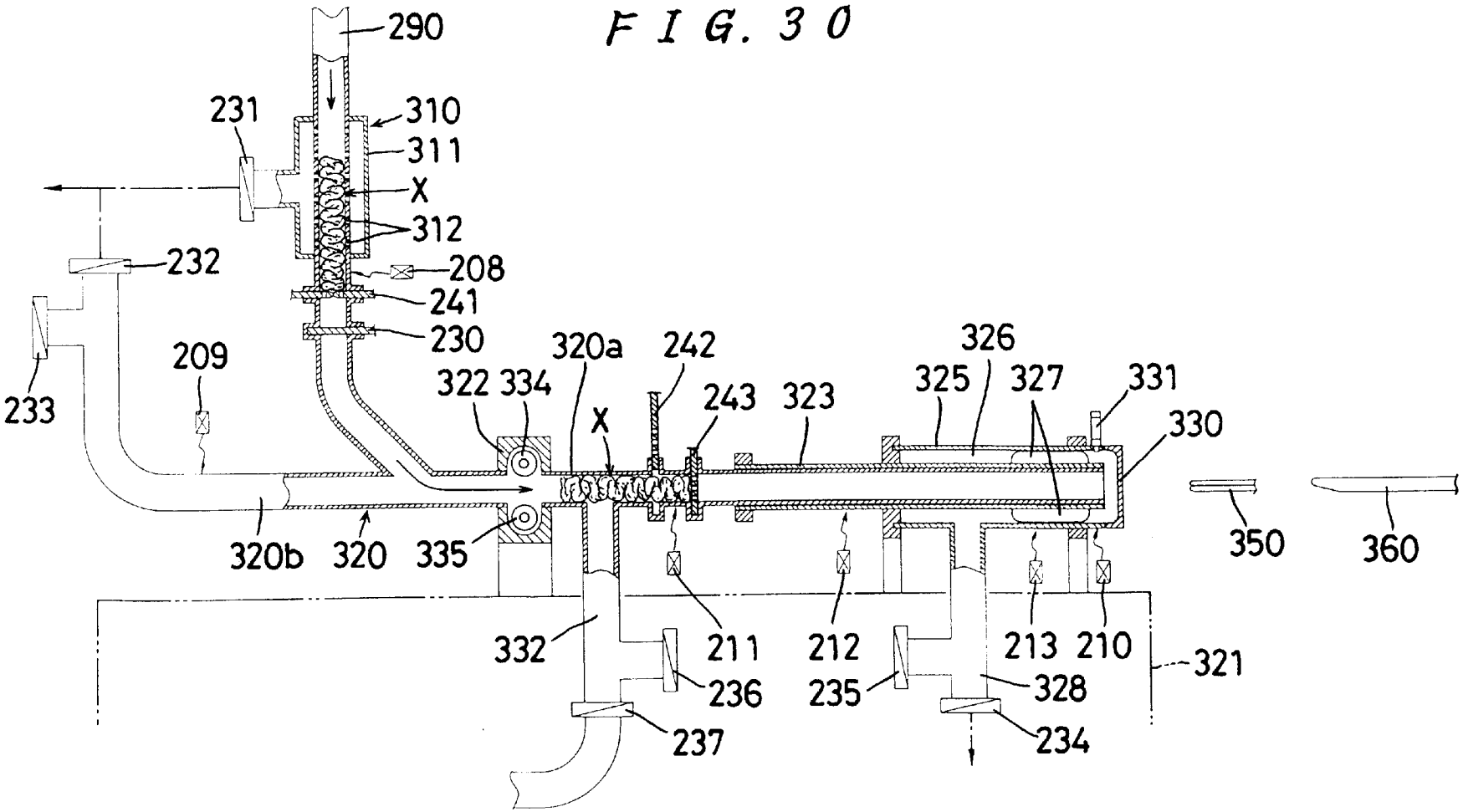
FIG. 30 is a partly sectional side view showing the relationship of the material with the stock means end and the welt-portion opening mechanism.

Then, upon the detection of the hose material X by the sensor 206 during this suction process, the pinching of the toe portion T by the pinching jigs 287, 288 is released so that the hose material X sucked into the transport pipe 290 is suction conveyed up to the stock means 310 through within the transport pipe 290 with the welt portion W headed as it is, and stops at the shutter 241 (see FIG. 30).

In addition, on the way of the conveyance within the transport pipe 290, upon detection of the material X by the sensor 207 (FIG. 19), the shutters 226, 227, 231 are closed. The closed shutters 226, 227 cause the pickup operation of the succeeding material by the second pickup mechanism 280 to be started, and the closed shutter 231 causes the suction force from the suction source A acting on the interior of the transport pipe 290 to be stopped.

When the end is decided as a welt portion W by the detection means 284:

In the state of FIG. 26, the hose material X picked up by the pickup bar 282 is suction held at its leg portion L rather sided to the toe portion T, while the welt portion W forming the lowermost end is pinched by the pinching jigs 287, 288 of the detection means 284.

From the above state, the shutter 225 is closed, the shutters 226, 229 are opened, so that the suction of the pickup bar 282 is stopped.

The closed shutter 225, as in the foregoing case where the end is decided as a toe portion T, causes the succeeding hose material X to be conveyed into the flat-lay passage 270, enabling the flat-laying operation of the hose material X to be started. Also, the opened shutters 226, 229 cause the suction force from the suction source A to act on the branch-connecting portion with the guide pipe 281, which forms the front end of the transport pipe 290, through the reversal pipe 301 of the reversal means 300, and moreover cause the suction holding on the toe portion T side to be released. Thus, the hose material X is suction conveyed from the transport pipe 290 into the reversal pipe 301 with the suction-released toe portion T side headed (see FIG. 28).

Figure 29:
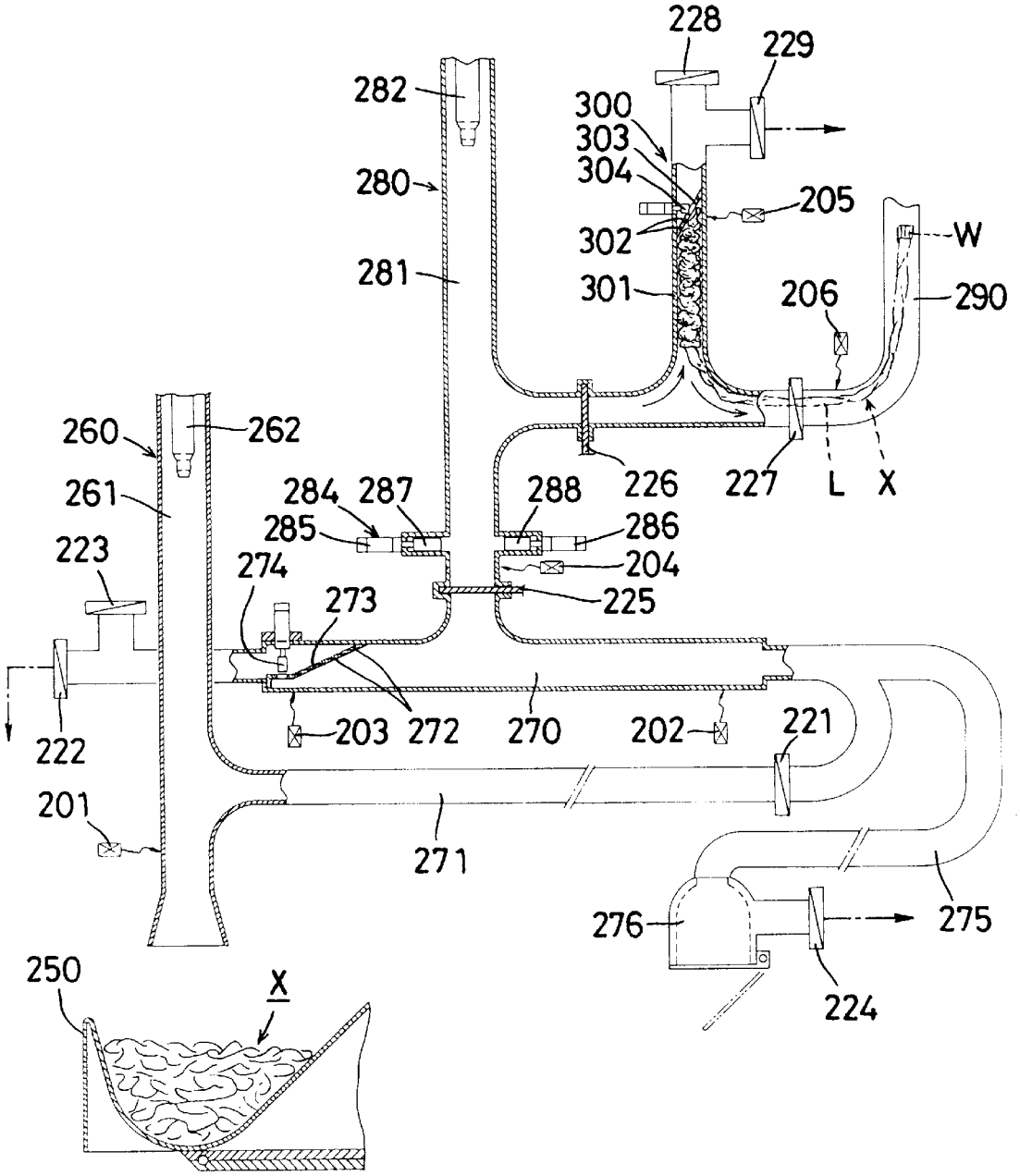
FIG. 29 is a partly sectional side view showing a reversed state of the material with the toe portion at the front end.

Then, upon the detection of the hose material X by the sensor 205 during this suction process, the holding jig 304 descends to hold the toe portion T side, while the holding of the welt portion W by the pinching jigs 287, 288 of the detection means 284 is released so that the hose material X on the whole is suction conveyed into the reversal pipe 301, and reserved in a bulk form by the blocking plate 303 (state of solid line in FIG. 29).

When the material X is reserved in bulk within the reversal pipe 301 with the toe portion T headed in this way, the shutters 226, 229 are then closed and the shutters 227, 228, 231 are opened. The closed shutter 226 causes the guide pipe 281 and the transport pipe 290 to be shut off, enabling the pickup operation of the succeeding hose material X by the second pickup mechanism 280 to be started. The closed shutter 229 causes the sucking operation into the reversal pipe 301 to be stopped.

Also, the opened shutters 227, 231 cause the suction force from the suction source A to act on the reversal pipe 301 from the suction small holes 312 of the stock means 310 through the transport pipe 290. In addition, the opened shutter 228 serves for air intake into the reversal pipe 301.

As a result, the hose material X reserved in bulk within the reversal pipe 301 is suction conveyed from the reversal pipe 301 through the transport pipe 290 with the welt portion W headed in turn (state of dot-chain line in FIG. 29). On the with of this conveyance, the sensor 206 detects the hose material X, so that the holding jig 304 ascends back, releasing the up-to-now material holding on the toe portion T side.

Therefore, the hose material X is suction conveyed up to the stock means 310 via the transport pipe 290 with the welt portion W headed, and stopped by the shutter 241 (see FIG. 30). In addition, when the sensor 207 (FIG. 19) detects the material X on the way of the conveyance within the transport pipe 290, the shutters 227, 228, 231 are closed, causing the sucking operation into the transport pipe 290 to be stopped.

As described above, even if the hose material X picked up from the storage container 250 is positioned with the welt portion headed or the toe portion headed, whichever it is, the material conveyed to the stock means 310 is position-controlled so that its welt portion is necessarily headed.

The hose material X reserved in the stock means 310 in this way is then detected by the sensor 9. Upon this detection, the shutters 241, 230, 233, 234 are opened.

The opened shutter 234 causes a suction force from the suction source B to act on the interior of the material stretching pipe 320 through the suction passage 326 between the large-diameter pipe 325 and the slide pipe 323. The opened shutter 233 serves for introduction of outside air into the pipe 320.

As a result, the opened shutters 241, 230 cause he material X reserved in the stock means 310 to be conveyed into the material stretching pipe 320 with the belt portion W headed, and stopped by the shutter 243 (state of dot-chain line in FIG. 30).

In addition, for the opening of the shutters 241 and 230, the shutter 230 is first fully opened and then the shutter 241 is gradually opened (both-side opened), so that the material X can be conveyed into the pipe 320 reliably in correctly headed position (with the welt portion W headed) while being prevented from one-sided conveyance.

When the material X is stopped by the shutter 243, the material X is then detected by the sensor 211. The detection of the material by the sensor 211 causes the shutters 242, 241, 230, 233 and 234 to be closed, and the shutters 232, 236 to be opened.

Figure 31:
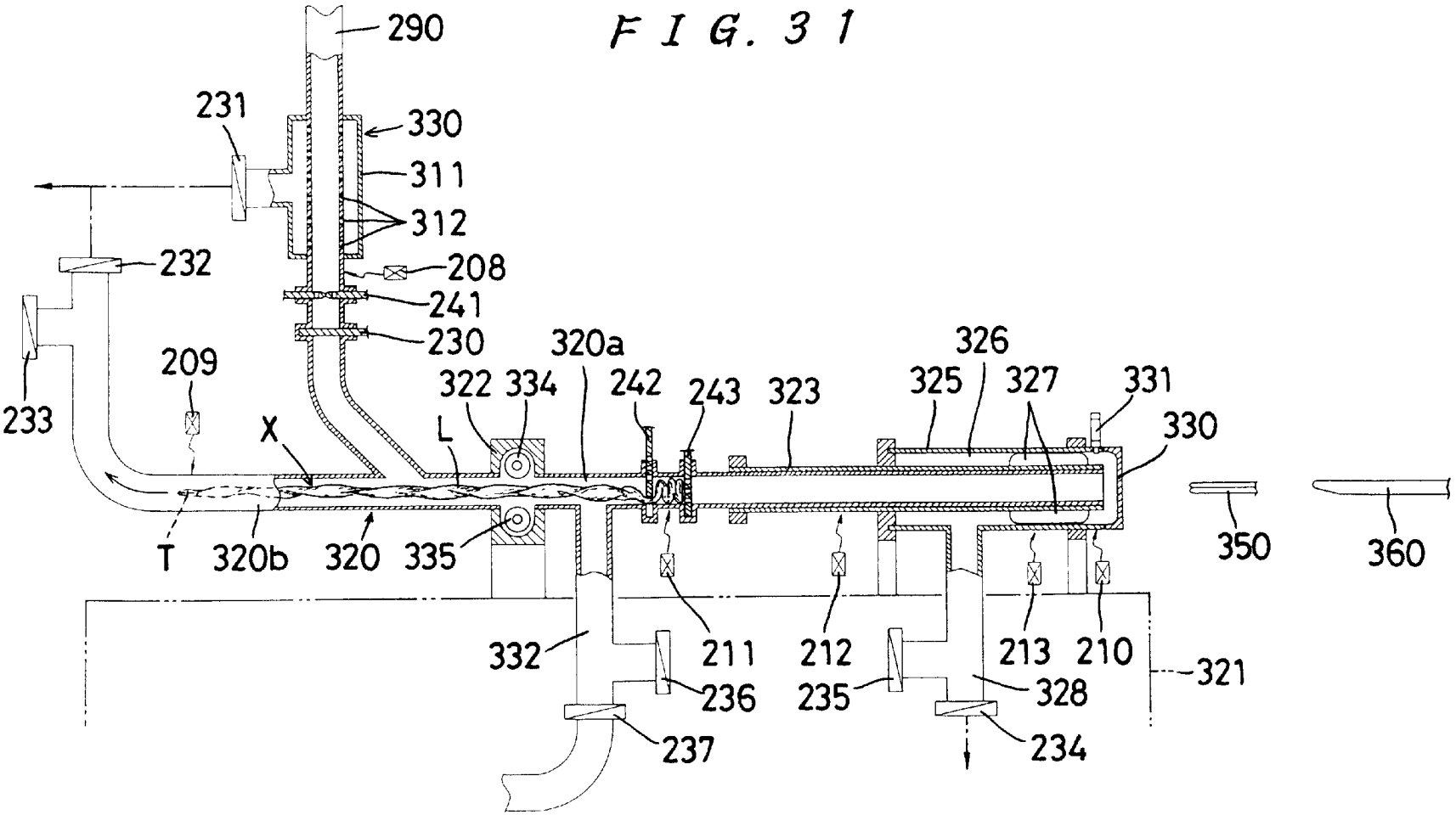
FIG. 31 is a partly sectional side view showing a stretched state of material in the welt-portion opening mechanism.

The closed shutter 242 holds the material X that has been stopped at the shutter 243, by a portion on the welt portion W side (see FIG. 31). The closed shutters 241, 230 enable the succeeding material X to be reserved within the stock means 310, and the closed shutter 233, 234 stop the suction force from the suction source B that acts on the stretching pipe 320. Also, the opened shutter 232 causes the suction force from the suction source A to act in the material stretching pipe 320 in a direction opposite to the direction of the suction force from the suction source B, and the opened shutter 236 serves for introduction of outside air.

As a result, the material X stopped at the shutter 243 is held at a near portion by the shutter 242, while the rest of the material is stretched by suction force toward the direction of the rear pipe 320*b* of the material stretching pipe 320 with the toe portion Theaded (see FIG. 29).

When the material X is stretched toward the rear pipe 320*b* of the material stretching pipe 320, the material X is detected by the sensor 209. This detection of material by the sensor 209 causes the roller 334 to descend and pinch the leg portion L of the material X against the roller 335, and besides causes these rollers to rotate. Synchronously with this, the shutters 242, 243 and the shutter 234 are opened.

Figure 32:
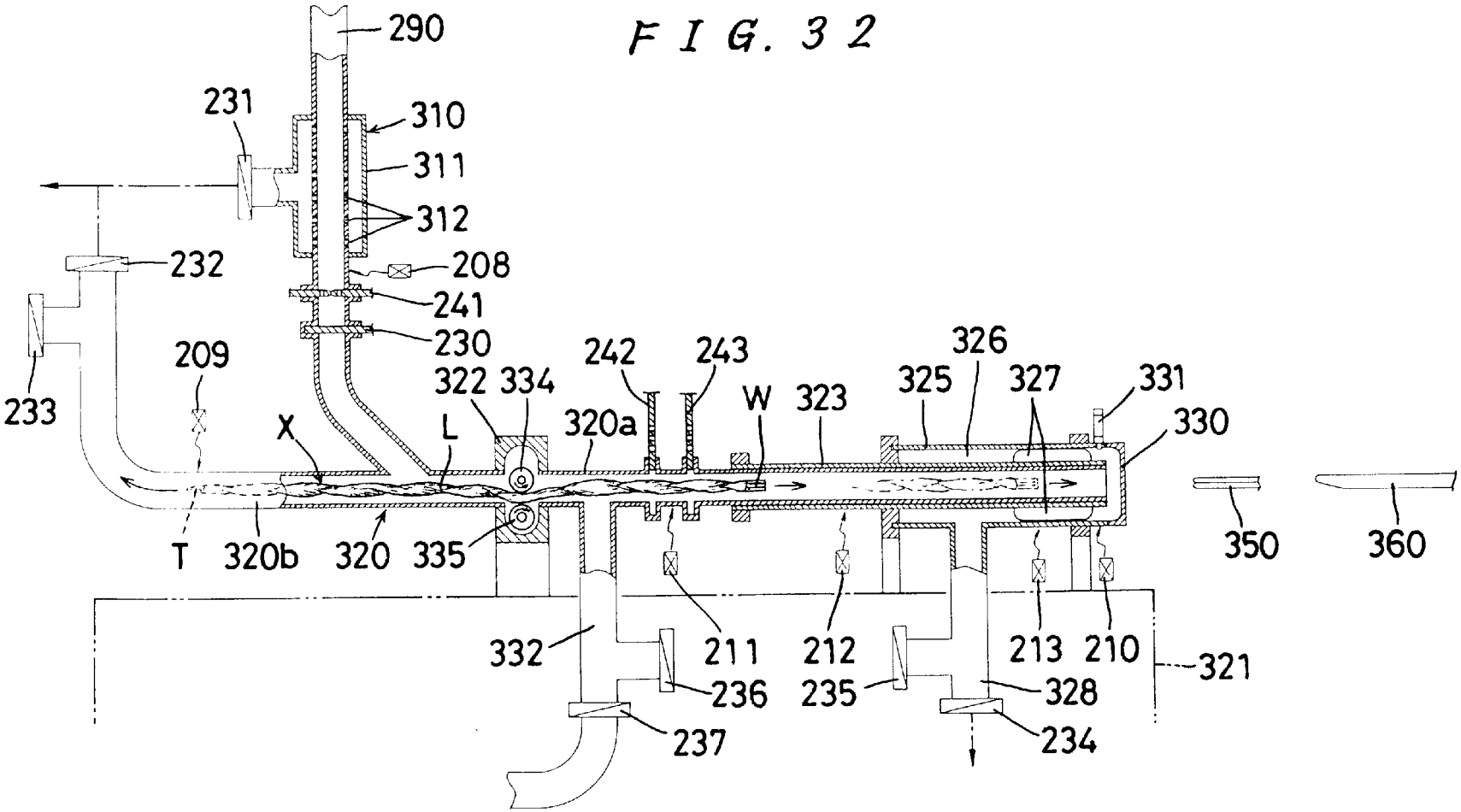
FIG. 32 is a partly sectional side view showing a state during the feed of the material for the welt-portion opening mechanism.

The opened shutters 242, 243 release the holding of the material X, and moreover put front and rear portions of the material stretching pipe 320 into a communicated state. Besides, the opened shutter 234 causes a suction force from the suction source B to act on the interior of the material stretching pipe 320 through the suction passage 326 again between the large-diameter pipe 325 and the slide pipe 323. In this operation, a suction force from the suction source A acts also on the rear side of the material stretching pipe 320, so that the material X is held at the leg portion L around its center by the rollers 334, 335 as shown in FIG. 32. As a result, the welt portion W is sucked up toward the front side of the material stretching pipe 320 and the toe portion T is sucked up toward the rear side of the material stretching pipe 320, respectively.

From the above state, the material X is forcedly conveyed forward of the material stretching pipe 320 by the rotational drive of the rollers 334, 335. On the way of the conveyance, upon detection of the material by the sensor 212, the rotation of the rollers is reduced in speed a low speed (about one third of the initial speed), and then, upon detection by the sensor 213, the rotation of the rollers is further reduced in speed to a micro-low speed (to about one tenth of the initial speed), in which state the welt portion W of the material is conveyed toward the front end side of the material stretching pipe 320 (state of dot-chain line in FIG. 32).

During the conveyance of the hose material X by the rollers 334, 335, the material under conveyance is prevented from being bit into the rollers, by pulling the toe portion T side of the material X with a suction force. Also, the rotation of the rollers 334, 335 is reduced in speed so that the conveyance speed of the material X is reduced to low, thus allowing the unfolding operation with the opening of the welt portion W, as will be described later, to be achieved more reliably.

Figure 33:
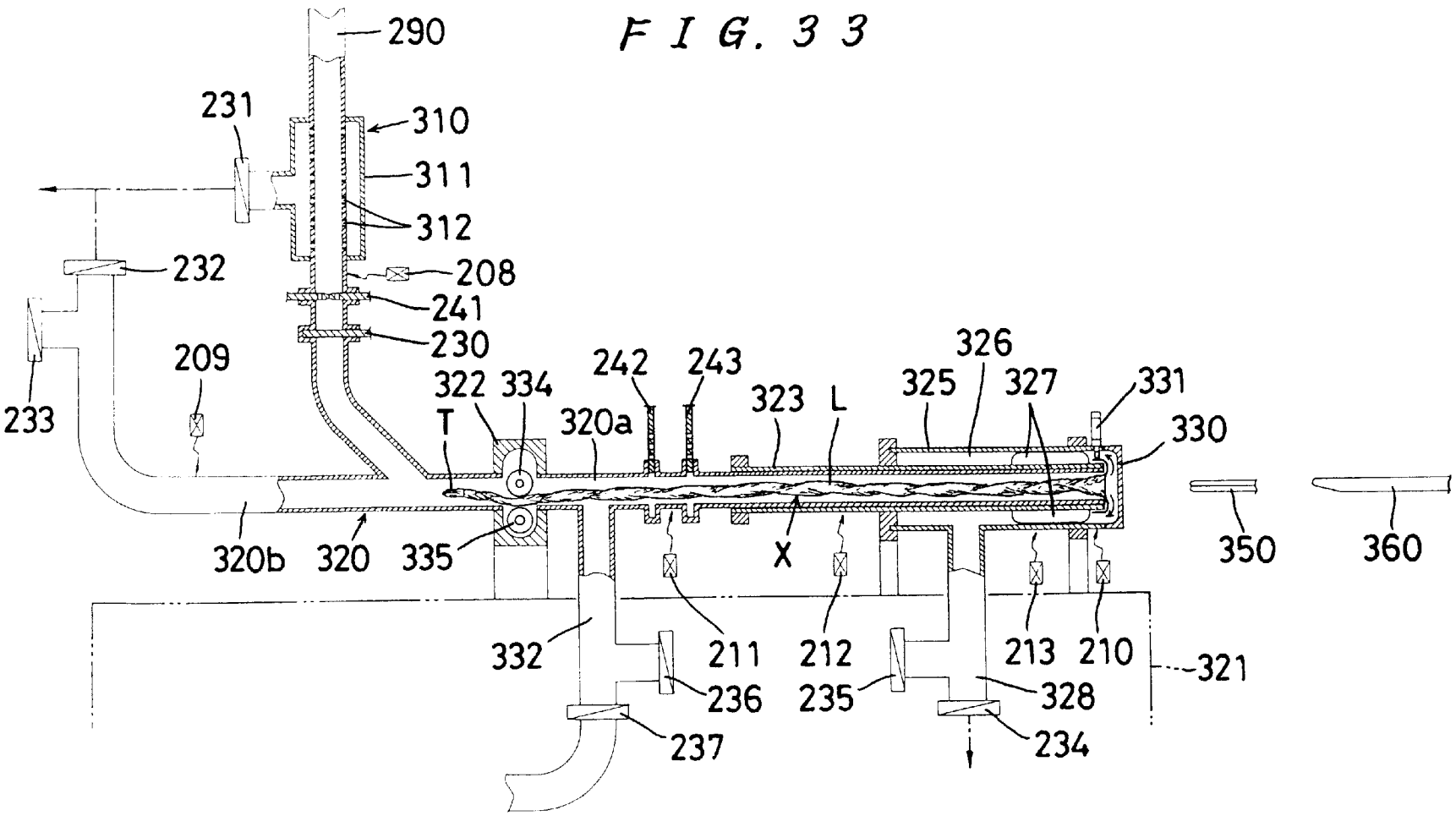
FIG. 33 is a partly sectional side view showing the opening of the welt portion and an unfolded state.

Over these steps, when the welt portion W of the material X is conveyed to the front end portion of the material stretching pipe 320, the welt portion W is then unfolded on the outer periphery of the front end portion of the slide pipe 323, while being opened as if it were a flower blooming, by a suction air flow acting on the suction passage 326 provided between the slide pipe 323 and the large-diameter pipe 325, where the suction air So flow is acting evenly on the circumference as shown by arrows in FIGS. 23 and 24 (see FIG. 33).

Now that the welt portion W has been unfolded on the slide pipe 323, the welt portion W is detected by a plurality of sensors 210. For example, three sensors 210 are placed at equally-divided-in-three positions on the circumference, respectively, as shown in FIG. 24, where a detection by all the sensors is decided as a good unfolding while no detection even by one sensor is decided as a faulty unfolding.

When all the sensors 210 have detected the welt portion W unfolded on the slide pipe 323, the rollers 334, 335 are first stopped from rotating, causing the material X to be stopped from being conveyed, while a plurality (three) of pinching jigs 331 are lowered, causing the unfolded welt portion W to be pinched on the slide pipe 323. Then, the shutters 234, 236, 232 are closed to stop the suction forces derived from the suction sources A and B that act from the front and rear of the material stretching pipe 320. After that, the upper roller 334 that has been stopped from rotating is made to ascend back, thereby releasing the pinching of the material by the rollers and thereafter the pinching jig 331 is also made to ascend back, thereby releasing the pinching of the unfolded welt portion W.

The purpose of pinching the unfolded welt portion W by the pinching jig 331 is to prevent the occurrence of such a failure that the material expanded during the up-to-now suction conveyance process is pulled back conversely and, as a result, the unfolded welt portion W is also returned in opposite direction, thus resulting in a faulty unfolding, while the suction within the slide pipe 323 is kept stopped (at this time point, the leg portion of the material is pinched by the rollers 334, 335).

Figure 34:
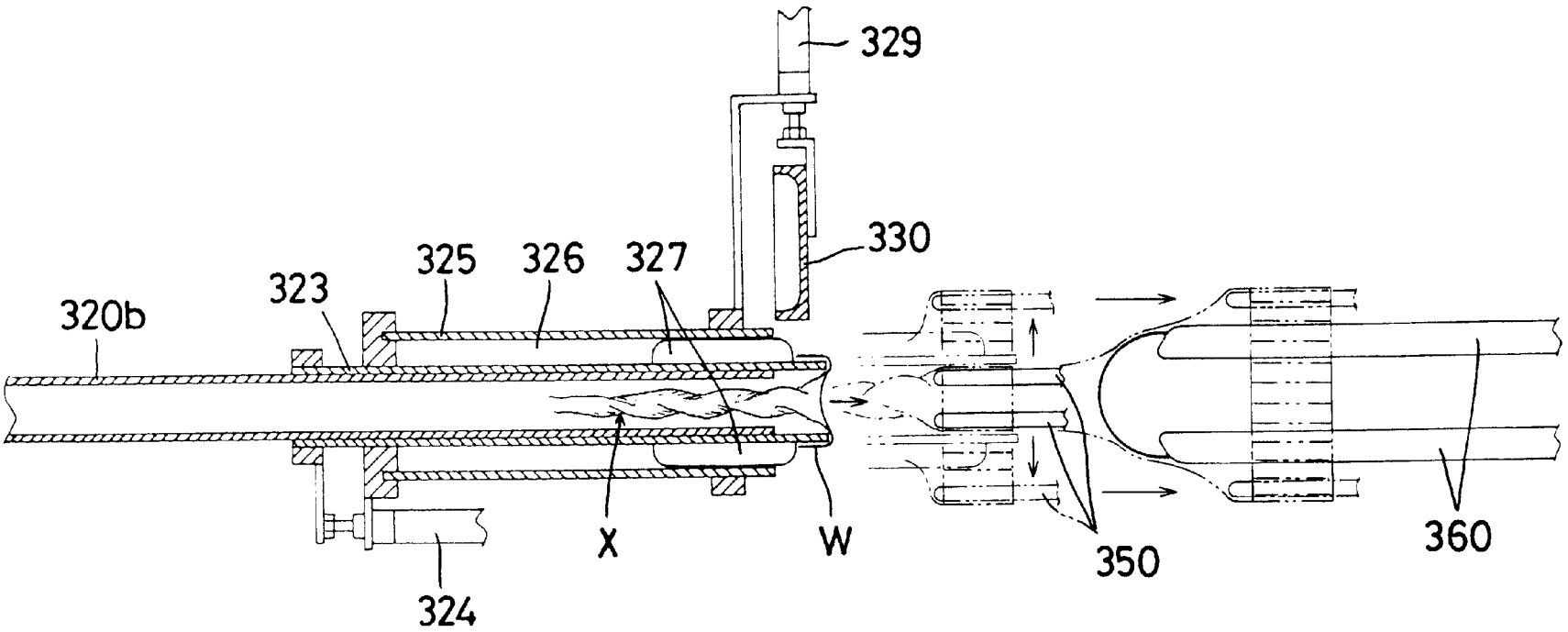
FIG. 34 is a partly sectional plan view showing a state in which the unfolded welt portion is delivered to the fitting arm and fitted to the bite means.
Figure 35:
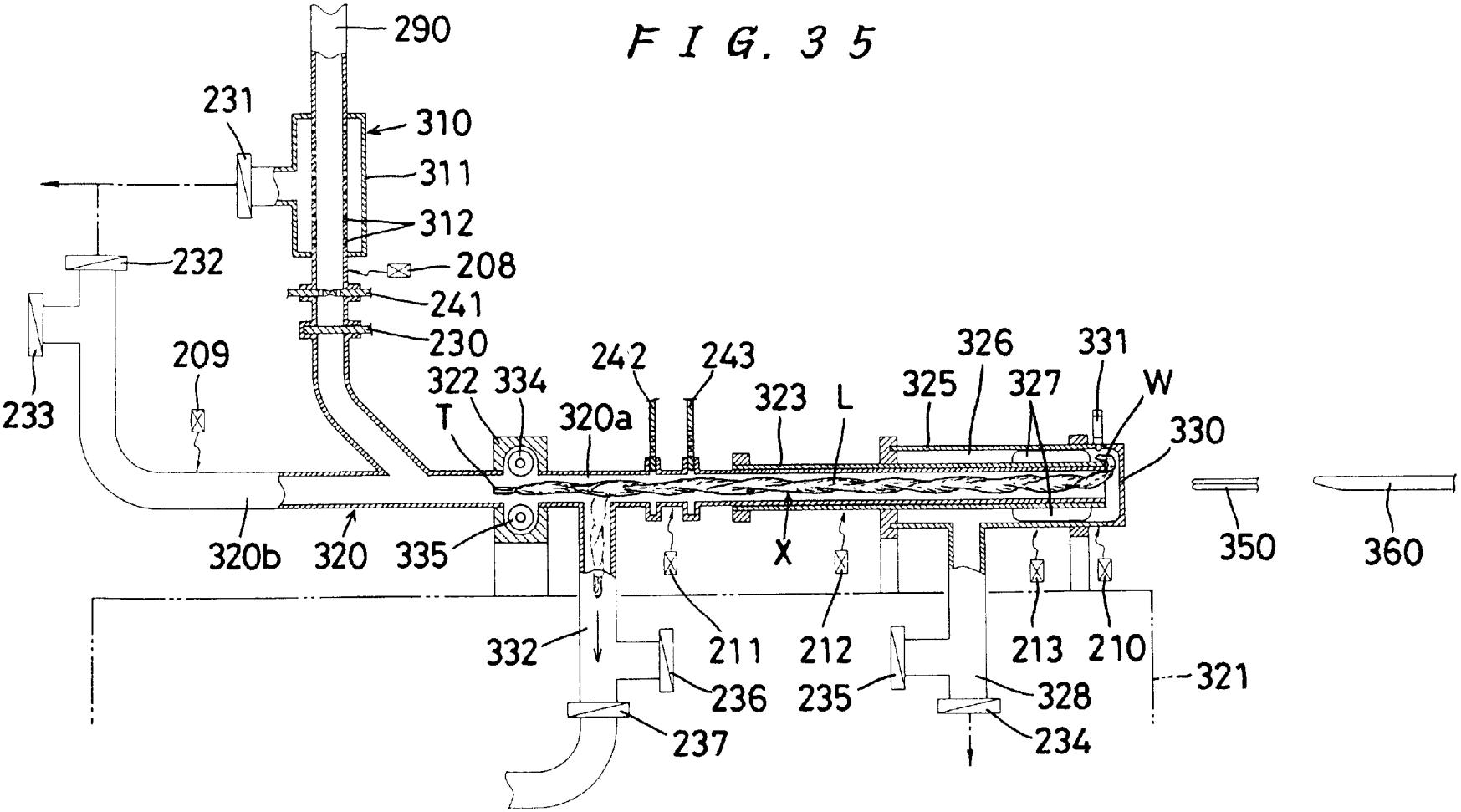
FIG. 35 is a partly sectional side view showing a state of response to an opening failure of the welt portion.

When the welt portion W of the hose material X has been fully unfolded on the slide pipe 323 in this way, the lid 330 is then opened by the operation of the cylinder 329, and thereafter the slide pipe 323 is advanced by the operation of the cylinder 324, by which the welt portion W unfolded on the slide pipe 323 is delivered onto a fitting arm 350 that is standing by there (see FIG. 34).

This delivery work, as apparent from FIG. 34, is achieved by the process that the fitting arm 350 moves in contact with the inner circumferential surface of the slide pipe 323, by which the welt portion W unfolded on the outer periphery of the slide pipe 323 is delivered so as to cover the fitting arm 350 while being turned back.

Now that the welt portion W material has been delivered to the fitting arm 350 and that the rest of the material has been removed from the material stretching pipe 320, then the slide pipe 323 retreats back, and the lid 330 is closed and the shutter 243 is closed, thus completing the processing work of one cycle and returning to the initial state.

Meanwhile, the hose material X whose welt portion W has been delivered to the fitting arm 350 is expanded in its welt portion W by the up-and-down, right-and-left expansion of the fitting arm 350, and thereafter fitted to a bite member 360 of the crotch sewing machine (see FIG. 34).

In addition, the above description has been made on a case where the opening folding of the welt portion W is decided to be a good one. If it should be decided to be faulty (e.g., state of FIG. 35), the shutters 234, 236, 232 are first closed and the rollers 334, 335 are stopped from rotating, while the roller 334 is made to ascend back and then the shutters 237, 238, 236 are opened.

The closed shutters 234, 236, 232 cause the suction forces derived from the suction sources A, B and having acted on the front and rear sides of the material stretching pipe 320 to be stopped, and the rollers 334, 335 that have been stopped from rotating and returned up back cause the feeding and pinching of the material X to be released. Also, the opened shutters 237, 238, 236 cause the suction force from the suction source A to act on the interior of the discharge pipe 332 via the discharge valve 333 (FIG. 19), by which the material X present in the material stretching pipe 320 is pulled into this discharge pipe 332 (state of dot-chain line in FIG. 35) and returned, as it is, from the discharge valve 333 to the storage container 250 through the discharge pipe 332. In addition, the opened shutter 236 serves for introduction of outside air.

During the conveyance of the hose material X within the discharge pipe 332, upon detection of the material X by the sensor 214, the shutters 237, 238, 236 and the shutter 243 are closed to the initial state.

The bite member 360 of the crotch sewing machine comprises upper-and-lower one pair, and right-and-left two pairs of bite plates. The hose material X is fitted to the upper right-and-left pair of bite plates and the lower right-and-left pair of bite plates, each one piece of material for each pair of bite plates.

As already described, in the processing apparatus of the present invention, one piece of material X is fitted to one (lower) right-and-left pair of bite plates of the bite member 360 via the fitting arm 350 in one cycle of processing work from the pickup of the hose material X to the delivery to the fitting arm 350. Accordingly, in order to fit another material X to the other (upper) right-and-left pair of bite plates, one more cycle of processing work is necessitated. However, fitting the material X to the upper and lower right-and-left pairs of bite plates by repeating two times of processing work would take longer time for the fitting work, which would be inefficient and leads to deterioration of the power of the crotch sewing machine.

Therefore, in order to solve these problems for more efficient operation of the crotch sewing machine, it is preferable to provide separately another processing apparatus having the same construction and the same functions as those of the processing apparatus of the present invention as described above, so that individual respective pieces of hose material X can be fitted to the upper and lower right-and-left pairs of bite plates of the bite member 360 by using the two sets of processing apparatus.

FIGS. 19 and 20 outline the state in which the second set of processing apparatus (shown by partly omitted two-dot chain line) is provided in combination with one set of processing apparatus. More specifically, the second set of processing apparatus also comprises a feed-posture control mechanism which is made up of a first pickup mechanism 260*a* placed just above a storage container 250, a flat-lay passage 270*a*, a second pickup mechanism 280*a*, a transport pipe 290*a*, reversal means (not shown) and stock means 310*a*, and a welt-portion opening mechanism (placed at a stage upper than the welt-portion opening mechanism of the first set) which is made up of a material stretching pipe (not shown), a slide pipe 323*a*, a large-diameter pipe 325*a* and the like.

In this way, by providing two sets of processing apparatus of this invention, and by also providing upper and lower two sets of fitting arms 350 (FIG. 19), the material is fitted to the upper and lower right-and-left pairs of bite plates of the bite member 360, individually and synchronously.

As described above, in the first embodiment of the present invention, the hose material sucked up by the pickup means is detected as to whether its end is a welt portion or a toe portion, depending on the thickness of the material. Therefore, the detection precision between the welt portion and the toe portion is greatly improved so that the posture control of the hose material can be free from any error, and that the process can be simplified with minimized malfunction in detection.

Also, because the stock means is provided on the way of the transport pipe, the pickup work, the reversal work and the delivery work to the welt-portion opening mechanism can be performed simultaneously in parallel and synchronously, so that the work efficiency can be improved to a great extent.

Further, because the material is forcedly fed to the welt portion opening side by a pair of feed rollers placed within the closed box provided on the way of the material stretching pipe, the apparatus construction is simplified while the apparatus length can be reduced, thus making it possible to save the space for installation of the apparatus.

In the second embodiment of the present invention, it becomes possible to carry out a step of picking up the hose material from the storage container by the first pickup mechanism, a step of laying down the picked-up material flat along the longitudinal direction of the flat-lay passage, a step of picking up the flat-laid material by the second pickup mechanism, a step of posture controlling the picked-up material via the detection means and conveying it to the stock means, and a step of opening the welt portion of the hose material and delivering it to the fitting arm, synchronously and iteratively under the phase differences between working positions of those individual steps. Therefore, the work from the pickup of the material to its delivery can be implemented promptly and efficiently so that the working efficiency can be improved to a large extent.

Further, in the step of laying down the hose material along the longitudinal direction of the flat-lay passage, if two or more pieces of material are conveyed into the flat-lay passage, one piece of material to be laid flat is left while the other material is returned to the storage container. Therefore, even in the case where two or more pieces of material are picked up, it can be ensured that one piece of material is reliably selected on the flat-lay passage, so that the subsequent steps can be freed from any obstacles.

Further, the welt-portion opening mechanism is so arranged that the welt portion of the hose material is opened and fully unfolded onto the slide pipe, and that the unfolded welt portion is temporarily pinched and held. Therefore, the welt-portion opening mechanism prevents the unfolded portion from restoring to the original state and thus reliably maintains its opened state reliably, during the halt of suction within the pipe. As a result, the delivery work of the opened welt portion to the fitting arm can be achieved with higher reliability.

That which is claimed:

1. A method of delivering hosiery blanks, each having a welt end and a toe end, welt end first for further processing, said method comprising:

removing a hosiery blank from a surface by a suction nozzle and conveying the blank vertically with at least a portion of the blank depending from the nozzle, determining the orientation of the suspended blank by measuring the thickness of a free end thereof, conveying the hosiery blank along a selected one of two alternate paths of travel based on the orientation of the suspended blank as determined and delivering the blank welt end first to a blank preparation location, clamping a medial portion of the blank between a pair of feed rolls and extending opposite portions of the blank on opposite sides of the feed rolls to their full length, and preparing the blank for transfer to another location for further processing by opening the welt end of the blank and everting a portion thereof while feeding the blank forwardly by the feed rolls.

2. A method according to claim 1 wherein the blank is removed from a storage container in which the hosiery blanks are stored randomly.

3. A method according to claim 1 wherein the blank is removed from a surface on which the blank has been laid flat.

4. A method according to claim 3 wherein the blank is removed from a storage container in which the hosiery blanks are stored randomly, conveyed to the surface and deposited thereon in a flat condition.

5. A method according to claim 1 in which the suction nozzle has a truncated conical shape and an opening in a side face thereof connected to a source of suction to limit the blanks removed to a single hosiery blank.

6. A method according to claim 2 wherein any additional hosiery blanks clinging to the blank being removed are dislodged therefrom by a stream of high velocity air directed thereagainst.

7. A method according to claim 1 wherein the hosiery blank is temporarily stored in a temporary storage area intermediate the orientation determination and the blank preparation location.

8. A method according to claim 1 wherein the welt portion is partially everted by opening the welt portion and folding the outer end portion thereof back upon the remainder of the welt portion over the end portion of a transport pipe.

9. A method according to claim 8 including sensing the folded-back web portion at a plurality of locations to ensure even and complete partial eversion thereof.

10. A method according to claim 9 including temporarily pinching the folded-back web portion at a plurality of locations to prevent reverse movement thereof.

11. A method of delivering hosiery blanks in proper orientation for further processing, the hosiery blanks having welt end and toe end portions, said method comprising:

removing a hosiery blank from a storage container in which the hosiery blanks are stored randomly by a suction nozzle which ascends and descends above the storage container and from which the hosiery blank is suspended, detecting the orientation of the suspended blank by determining whether a free end of the blank is a welt end or a toe end, conveying the hosiery blank welt end first by suction within a transport pipe to a welt opening location, opening the welt end of the hosiery blank by partial eversion of the welt portion over the end of the transport pipe, and delivering the opened welt portion onto a fitting arm for transfer of the hosiery blank for further processing.

12. A method according to claim 11 wherein the hosiery blank is clamped at a medial location at the welt opening location and mechanically fed forwardly toward the end of the transport pipe during welt opening.

13. A method according to claim 11 including temporarily storing the hosiery blank between the orientation detection and the welt opening location.

14. A method according to claim 11 wherein the suction nozzle is of a truncated conical shape and has suction holes in a side wall thereof to ensure, to the extent possible, that a single hosiery blank is removed.

15. A method according to claim 11 including dislodging any additional hosiery blanks clinging to the removed hosiery blank by directing a high velocity air stream thereagainst.

16. Apparatus for delivering hosiery blanks in proper orientation for further processing, the hosiery blanks having welt end and toe end portions, said apparatus comprising a storage container for storing hosiery blanks randomly, hosiery blank removing means mounted for descending and ascending movement relative to said storage container for removing a hosiery blank from said storage container and for carrying the hosiery blank upwardly from the storage container along a first predetermined path of travel, said removing means including a suction nozzle for releasably holding a hosiery blank against said nozzle, detecting means located along said first predetermined path of travel of said removing means for detecting the orientation of the hosiery blank by determining whether a free end of the hosiery blank is a welt end or a toe end, conveying means for conveying the hosiery blank welt end first from said detecting means along a second predetermined path of travel and including a transport pipe connected to a source of suction and terminating in a free end, welt opening means located at the free end of said transport pipe for opening the welt end portion of the hosiery blank by partially everting the welt end portion of the hosiery blank over the free end of said transport pipe, and transfer means for transferring the hosiery blank to a further processing machine and including a fitting arm insertable into the partially everted welt end portion.

17. Apparatus according to claim 16 including clamping and feeding means for clamping a medial portion on the hosiery blank as it arrives at said welt opening means and for feeding the hosiery blank toward the free end of said transport pipe.

18. Apparatus according to claim 17 wherein said clamping and feeding means comprises a pair of feed rolls, at least one of which is mounted for movement toward and away from the other feed roll for clamping and releasing the hosiery blank and being driven to feed the hosiery blank.

19. Apparatus according to claim 17 including means for extending the hosiery blank to its full length on opposite sides of said clamping and feeding means.

20. Apparatus according to claim 16 including temporary storage means operatively associated with said transport pipe for receiving and storing temporarily the hosiery blank between said detecting means and said welt opening means.

21. Apparatus according to claim 16 wherein said removing means delivers the hosiery blank to transport means for conveying the hosiery blank to a supporting surface, blank extending means for extending the hosiery blank substantially to its full length and for depositing the extended blank on said supporting surface, and pick-up means for removing the hosiery blank from said supporting surface and for lifting the blank upwardly to said detecting means.

22. Apparatus according to claim 16 wherein said welt opening means includes a suction chamber surrounding the free end of said transport pipe for everting a portion of the welt end portion over and around the free end of said transport pipe.

23. Apparatus according to claim 22 including a plurality of sensors spaced around said suction chamber for sensing the everted welt end portion at a plurality of locations around said transport pipe to ensure proper eversion of the welt end portion.

24. Apparatus according to claim 23 including reject means responsive to any one of said sensors sensing an improperly everted welt end portion for returning the hosiery blank to said storage container.

* * * * *